US008404412B2

(12) United States Patent
Mitsumori

(10) Patent No.: US 8,404,412 B2
(45) Date of Patent: Mar. 26, 2013

(54) ELECTROPHOTOGRAPHIC PHOTORECEPTOR, AND IMAGE FORMING APPARATUS

(75) Inventor: Teruyuki Mitsumori, Yokohama (JP)

(73) Assignee: Mitsubishi Chemical Corporation, Tokyo (JP)

( * ) Notice: Subject to any disclaimer, the term of this patent is extended or adjusted under 35 U.S.C. 154(b) by 606 days.

(21) Appl. No.: 12/095,647

(22) PCT Filed: Dec. 1, 2006

(86) PCT No.: PCT/JP2006/324101

§ 371 (c)(1), (2), (4) Date: May 30, 2008

(87) PCT Pub. No.: WO2007/063989

PCT Pub. Date: Jun. 7, 2007

(65) Prior Publication Data

US 2010/0221040 A1 Sep. 2, 2010

(30) Foreign Application Priority Data

Dec. 2, 2005 (JP) ..... 2005-349209

(51) Int. Cl.
*G03G 5/06* (2006.01)

(52) U.S. Cl. ..... 430/58.75; 430/59.5; 430/59.6

(58) Field of Classification Search ..... 430/58.75, 430/59.5, 59.6; 399/159
See application file for complete search history.

(56) References Cited

U.S. PATENT DOCUMENTS

| | | | | |
|---|---|---|---|---|
| 3,251,881 | A * | 5/1966 | Susi et al. | 564/309 |
| 4,273,846 | A * | 6/1981 | Pai et al. | 430/58.75 |
| 4,708,922 | A * | 11/1987 | Yokoya et al. | 430/73 |
| 4,758,488 | A * | 7/1988 | Johnson et al. | 430/58.2 |
| 4,830,944 | A | 5/1989 | Umehara et al. | |
| 4,877,702 | A | 10/1989 | Miyamoto et al. | |
| 4,923,774 | A * | 5/1990 | Van der Auweraer et al. | 430/58.75 |
| 5,059,503 | A * | 10/1991 | Muto et al. | 430/83 |
| 5,230,976 | A | 7/1993 | Schank et al. | |
| 5,538,826 | A * | 7/1996 | Ainoya et al. | 430/59.6 |
| 5,567,559 | A * | 10/1996 | Yang et al. | 430/59.5 |
| 5,707,768 | A | 1/1998 | Anzai et al. | |
| 5,840,980 | A | 11/1998 | Anzai et al. | |
| 6,183,922 | B1 * | 2/2001 | Takai et al. | 430/72 |
| 6,335,132 | B1 * | 1/2002 | Tanaka et al. | 430/59.3 |
| 7,005,222 | B2 * | 2/2006 | Horgan et al. | 430/58.3 |
| 7,166,397 | B2 * | 1/2007 | Mishra et al. | 430/58.8 |
| 7,514,191 | B2 * | 4/2009 | Yanus et al. | 430/58.75 |
| 7,767,371 | B2 * | 8/2010 | Bender et al. | 430/58.75 |
| 2002/0076632 | A1 * | 6/2002 | Yanus et al. | 430/58.75 |
| 2003/0054274 | A1 * | 3/2003 | Mitsumori et al. | 430/96 |
| 2006/0029870 | A1 * | 2/2006 | Nukada et al. | 430/56 |
| 2006/0134541 | A1 | 6/2006 | Fujii et al. | |
| 2006/0292468 | A1 * | 12/2006 | Yokota et al. | 430/58.65 |
| 2007/0298341 | A1 * | 12/2007 | Wu et al. | 430/58.8 |

FOREIGN PATENT DOCUMENTS

| | | | |
|---|---|---|---|
| EP | 866110 | A1 * | 9/1998 |
| JP | 56 119132 | | 9/1981 |
| JP | 61 129648 | | 6/1986 |
| JP | 62 112163 | | 5/1987 |
| JP | 62 147462 | | 7/1987 |
| JP | 1 118141 | | 5/1989 |
| JP | 1 118143 | | 5/1989 |
| JP | 1 118144 | | 5/1989 |
| JP | 1 118145 | | 5/1989 |
| JP | 1 118146 | | 5/1989 |
| JP | 3-136059 | | 6/1991 |
| JP | 04233547 | A * | 8/1992 |
| JP | 5 158248 | | 6/1993 |
| JP | 5 249720 | | 9/1993 |
| JP | 8 152724 | | 6/1996 |
| JP | 8 179526 | | 7/1996 |
| JP | 9 316038 | | 12/1997 |
| JP | 10017531 | A * | 1/1998 |
| JP | 2000-105479 | | 4/2000 |
| JP | 2001 56595 | | 2/2001 |
| JP | 2001 166519 | | 6/2001 |
| JP | 2001 305764 | | 11/2001 |
| JP | 2002 49166 | | 2/2002 |
| JP | 2002-123007 | | 4/2002 |
| JP | 2003 21921 | | 1/2003 |

(Continued)

OTHER PUBLICATIONS

English language machine translation of JP 2003-021921 (Jan. 2003).*

Diamond, Arthur S. (ed.) Handbook of Imaging Materials. New York: Marcel-Dekker, Inc. (1991) pp. 401-403.*

Office Action dispatched May 17, 2011, issued in Japanese Patent Application 2006-325075 (with English Translation).

Japanese Office Action issued Feb. 21, 2012, in Patent Application No. 2007-147251 (with English-language translation).

(Continued)

*Primary Examiner* — Christopher Rodee

(74) *Attorney, Agent, or Firm* — Oblon, Spivak, McClelland, Maier & Neustadt, L.L.P.

(57) ABSTRACT

The present invention relates to an electrophotographic photoreceptor having an electroconductive substrate, and a charge transport layer and a charge generation layer formed on the substrate, characterized in that the charge transport layer contains a charge transport material represented by formula (1) and a binder resin, and the mass ratio of the charge transport material to the binder resin is from 5/100 to 45/100:

(1)

wherein $Ar^1$ is an arylene group which may have a substituent; each of $Ar^2$, $Ar^3$, $Ar^4$ and $Ar^5$ is an aryl group which may have a substituent; and n is an integer of from 3 to 6.

19 Claims, 3 Drawing Sheets

FOREIGN PATENT DOCUMENTS

| | | | |
|---|---|---|---|
| JP | 2003021921 A | * | 1/2003 |
| JP | 2003 270877 | | 9/2003 |
| JP | 2004 199051 | | 7/2004 |
| JP | 2005-165028 | | 6/2005 |
| JP | 2005-208591 | | 8/2005 |
| JP | 2005-292810 | | 10/2005 |
| JP | 2006-53549 | | 2/2006 |
| JP | 2007-11312 | | 1/2007 |
| JP | 2008-15532 | | 1/2008 |
| WO | 2006 054805 | | 5/2006 |

OTHER PUBLICATIONS

Japanese Office Action issued Feb. 21, 2012, in Patent Application No. 2007-147252 (with English-language translation).

Office Action issued Feb. 7, 2012, in Japanese Patent Application No. 2011-156633 (with English-language translation).

* cited by examiner

ELECTROPHOTOGRAPHIC PHOTORECEPTOR, AND IMAGE FORMING APPARATUS

TECHNICAL FIELD

The present invention relates to an electrophotographic photoreceptor comprising an electroconductive substrate, and a charge transfer layer and a charge generation layer formed the substrate. More particularly, it relates to an electrophotographic photoreceptor having favorable electric characteristics, stability and durability, and an image forming apparatus.

BACKGROUND ART

An electrophotographic technology has found widespread applications in the field of not only copying machines but also various printers and printing machines in recent years because it can provide an image of immediacy and high quality.

As for the photoreceptor which is the core of the electrophotographic technology, use of photoreceptors using organic photoconductive materials having advantages of retaining no pollution, ensuring easy film-forming, being easy to manufacture, and the like, has been the main stream in recent years instead of conventional inorganic photoconductive materials such as selenium, an arsenic-selenium alloy, cadmium sulfide or zinc oxide.

As the layer structure of the organic photoreceptor, there are known a so-called monolayer type photoreceptor obtained by dispersing a charge generation material in a binder resin, and a lamination type photoreceptor obtained by laminating a charge generation layer and a charge transport layer. The lamination type photoreceptor has been widely used because a stable high sensitivity photoreceptor can be provided by combining optimum layers of a charge generation material and a charge transport material each having a high efficiency, and characteristics are easily adjusted because of its wide material selection range. The monolayer type photoreceptor is slightly inferior to the lamination type photoreceptor in view of electric characteristics and its narrow material selection range, and accordingly has been used to a limited extent.

Further, the electrophotographic photoreceptor is repeatedly used in an electrophotographic process, i.e., in cycles of charging, exposure, development, transfer, cleaning, charge removal, and the like, during which it is subjected to various stress and will be deteriorated. Among such deteriorations, chemical deterioration may be a damage to a photosensitive layer by strongly oxidizing ozone or NOx risen from, for example, a corona charger commonly used as a charger. Thus, when the photoreceptor is repeatedly used, deterioration of electrical stability such as a reduction in the triboelectricity and an increase in the residual potential and accompanying image failure may occur. These are greatly due to chemical deterioration of a charge transport material contained in a large amount in the photosensitive layer.

Further, high sensitivity and high-speed response are required along with speeding up of the electrophotographic process in recent years. Among them, for high sensitivity, not only optimization of the charge generation material but also development of a charge transport material which well matches the charge generation material, has been required, and for high-speed response, development of a charge transport material having high mobility and showing a sufficiently low residual potential at the time of exposure has been required. In many cases, high sensitivity and high-speed response can be attained by increasing the content of a charge transport material against the binder resin. However, a photosensitive layer wherein the content of a charge transport material is large against a binder resin, has a problem such that the mechanical durability of the photosensitive layer tends to be poor in many cases, and so-called print durability for forming images repeatedly tends to deteriorate. Accordingly, a charge transport material is desired which makes high sensitivity and high-speed response possible even with an electrophotographic photoreceptor having a small content of the charge transport material in its photosensitive layer.

With a photoreceptor having a photosensitive layer having a small content of a charge transport material, a problem of leaking has been overcome, but it has been pointed out that the characteristics of the electrophotographic photoreceptor are likely to be substantially changed due to a change in the environment (the temperature, humidity, etc.), thus leading to an image defect (e.g. Patent Document 1). Further, with conventional charge transport materials, it is known that they tend to be deteriorated when exposed to an oxidizing gas represented by ozone, NOx or the like, and the durability was poor in repeated use especially when the environment in which the electrophotographic photoreceptor was used, was changed.

Patent Document 1: JP-A-2001-056595

DISCLOSURE OF THE INVENTION

Object to be Accomplished by the Invention

That is, with respect to photoreceptors to be used for copying machines, printers, fax machines, etc., it is widely desired to overcome the above-mentioned problems. The present invention has been made in view of such problems.

Namely, it is an object of the present invention to provide an electrophotographic photoreceptor which is excellent in electric characteristics and image characteristics even with a low content of a charge transport material and which undergoes little change in characteristics due to a change in the environment and has high durability with little deterioration, and an image forming apparatus having such a photoreceptor.

Means to Accomplish the Object

The present inventors have conducted an extensive study on a charge transport material which satisfies the above requirements and as a result, have found it possible to improve the electrical characteristics, the stability of characteristics and the durability of an electrophotographic photoreceptor by using a charge transport material having a specific structure in a specific amount, and thus have arrived at the present invention.

Namely, the present invention provides the following.

(1) An electrophotographic photoreceptor comprising an electroconductive substrate, and a charge transport layer and a charge generation layer formed on the substrate, characterized in that the charge transport layer comprises a charge transport material represented by the following formula (1) and a binder resin, and the mass ratio of the charge transport material to the binder resin (i.e. charge transport material/binder resin) is from 5/100 to 45/100:

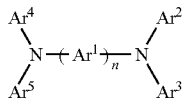

(1)

wherein $Ar^1$ is an arylene group which may have a substituent; each of $Ar^2$, $Ar^3$, $Ar^4$ and $Ar^5$ is an aryl group which may have a substituent; and n is an integer of from 3 to 6.

(2) An electrophotographic photoreceptor comprising an electroconductive substrate, and a charge transport layer and a charge generation layer formed on the substrate, characterized in that the charge transport layer contains a charge transport material represented by the following formula (1) and comprises a plurality of charge transport materials and a binder resin, and the mass ratio of the total mass of the plurality of charge transport materials to the binder resin (i.e. charge transport materials/binder resin) is from 25/100 to 55/100:

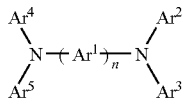

(1)

wherein $Ar^1$ is an arylene group which may have a substituent; each of $Ar^2$, $Ar^3$, $Ar^4$ and $Ar^5$ is an aryl group which may have a substituent; and n is an integer of from 3 to 6.

(3) An electrophotographic photoreceptor comprising an electroconductive substrate, and a charge transport layer and a charge generation layer formed on the substrate, characterized in that the charge transport layer contains a charge transport material represented by the following formula (1) and the charge generation layer contains oxytitanium phthalocyanine, and that the oxytitanium phthalocyanine is one obtained by chemical treatment of phthalocyanine crystal precursor, followed by contact with an organic solvent and is oxytitanium phthalocyanine showing main diffraction peaks at Bragg angles) (2θ±0.2°) of 9.5°, 24.1° and 27.2° in an X-ray diffraction spectrum by CuKα ray (wavelength: 1.541 Å):

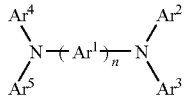

(1)

wherein $Ar^1$ is an arylene group which may have a substituent; each of $Ar^2$, $Ar^3$, $Ar^4$ and $Ar^5$ is an aryl group which may have a substituent; and n is an integer of from 3 to 6.

(4) An electrophotographic photoreceptor comprising an electroconductive substrate, and a charge transport layer and a charge generation layer formed on the substrate, characterized in that the charge transport layer comprises a charge transport material represented by the following formula (1) and a polyarylate resin:

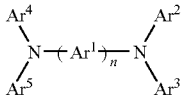

(1)

wherein $Ar^1$ is an arylene group which may have a substituent; each of $Ar^2$, $Ar^3$, $Ar^4$ and $Ar^5$ is an aryl group which may have a substituent; and n is an integer of from 3 to 6.

(5) An electrophotographic photoreceptor comprising an electroconductive substrate, and a charge transport layer and a charge generation layer formed on the substrate, characterized in that the charge transport layer comprises a charge transport material represented by the following formula (1) and a binder resin having a viscosity average molecular weight of from 10,000 to 70,000:

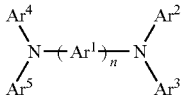

(1)

wherein $Ar^1$ is an arylene group which may have a substituent; each of $Ar^2$, $Ar^3$, $Ar^4$ and $Ar^5$ is an aryl group which may have a substituent; and n is an integer of from 3 to 6.

(6) The electrophotographic photoreceptor according to the above (1) or (2), wherein the charge transport layer contains crystalline oxytitanium phthalocyanine showing peaks at Bragg angles) (2θ±0.2°) of 9.5°, 24.1° and 27.3° in an X-ray diffraction spectrum by CuKα ray.

(7) An image forming apparatus having an electrophotographic photoreceptor comprising an electroconductive substrate, and a charge transport layer containing a charge transport material represented by the following formula (1) and a charge generation layer formed on the substrate, and designed to expose the electrophotographic photoreceptor with monochromatic light having a wavelength of from 380 to 500 nm to form an image:

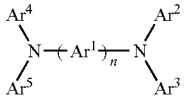

(1)

wherein $Ar^1$ is an arylene group which may have a substituent; each of $Ar^2$, $Ar^3$, $Ar^4$ and $Ar^5$ is an aryl group which may have a substituent; and n is an integer of from 3 to 6.

(8) An image forming apparatus having an electrophotographic photoreceptor comprising an electroconductive substrate, and a charge transport layer containing a charge transport material represented by the following formula (1) formed as the outermost layer on the substrate, and designed to charge the electrophotographic photoreceptor by a charger disposed in contact with the elecrophotographic photoreceptor to form an image:

(1)

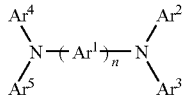

wherein $Ar^1$ is an arylene group which may have a substituent; each of $Ar^2$, $Ar^3$, $Ar^4$ and $Ar^5$ is an aryl group which may have a substituent; and n is an integer of from 3 to 6.

(9) An image forming apparatus having the electrophotographic photoreceptor as defined in any one of the above (1) to (6).

(10) An image forming apparatus having an electrophotographic photoreceptor as defined in any one of the above (1) to (6) and designed to expose the electrophotographic photoreceptor with monochromatic light having a wavelength of from 380 to 500 nm to form an image.

In the present invention, "weight" and "mass" have the same meaning.

Effects of the Invention

By use of the specific charge transport material in the present invention, compatibility of the binder resin and the charge transport material in the charge transport layer will be excellent, whereby formation of a photosensitive layer will be easy. It is thereby possible to provide an electrophotographic photoreceptor which is excellent in electric characteristics as an electrophotographic photoreceptor and has good durability and stability of characteristics and which is excellent in repetitive characteristics and print durability against environmental fluctuation, particularly under high temperature and high humidity conditions. Further, by using such a photoreceptor, it is possible to present an electrophotographic apparatus such as a printer, a facsimile machine or a copying machine, capable of providing a high image quality with a less consumption of the toner.

MEANING OF SYMBOLS

Figure 1:
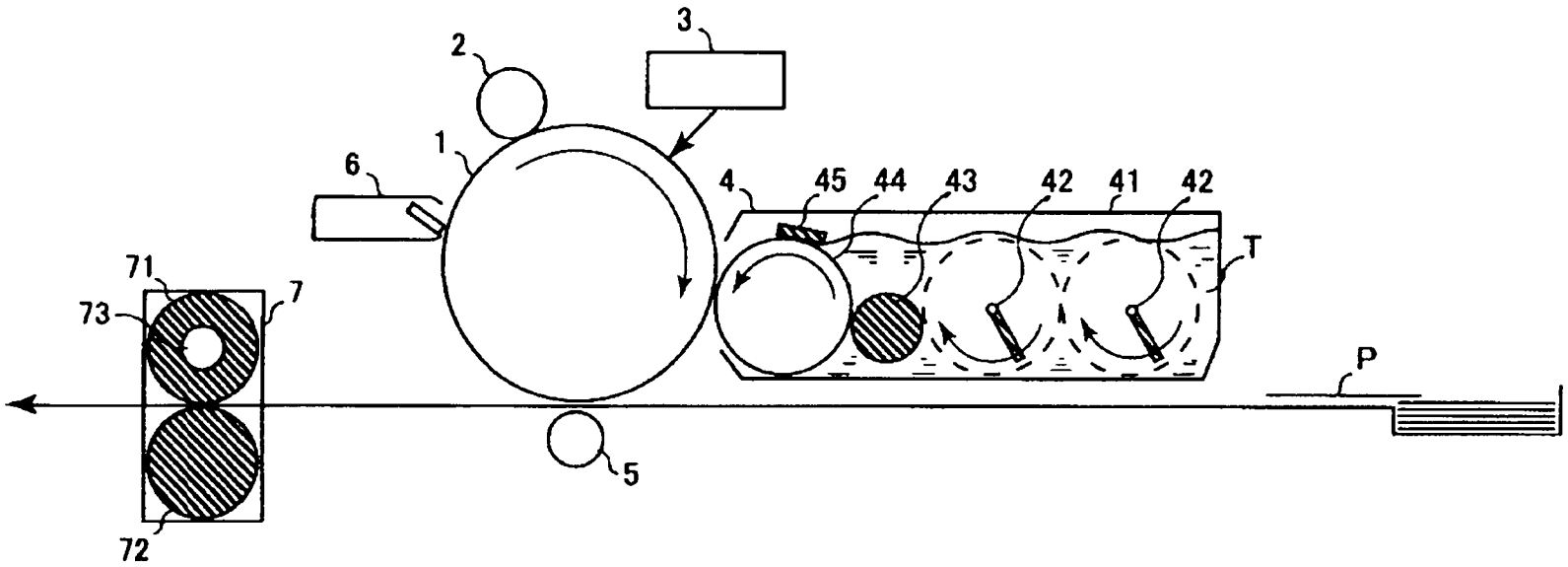
FIG. 1 is a drawing illustrating one example of an image forming apparatus of the present invention.

1. Photoreceptor
2. Charging apparatus (charging roller)
3. Exposure apparatus
4. Developing apparatus
5. Transfer apparatus
6. Cleaning means
7. Fixing means
41. Developing tank
42. Agitator
43. Supply roller
44. Developing roller
45. Control member
71. Upper fixing member
72. Lower fixing member
73. Heating apparatus
T Toner
P Recording medium

BEST MODE FOR CARRYING OUT THE INVENTION

Now, the present invention will be described in detail with reference to the preferred embodiments. However, it should be understood that the following description of the constituting elements relates to typical embodiments of the present invention, and various changes and modifications can be made without departing from the spirit and scope of the present invention.

The charge transport layer in the electrophotographic photoreceptor of the present invention contains a charge transport material represented by the following formula (1):

(1)

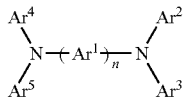

In the formula (1), $Ar^1$ is an arylene group which may have a substituent; each of $Ar^2$, $Ar^3$, $Ar^4$ and $Ar^5$ is an aryl group which may have a substituent; and n is an integer of from 3 to 6.

The arylene group represented by $Ar^1$ may be any group so long as it is a group having an aromatic nature and may, for example, be a group having a so-called aromatic ring containing the largest number of non-cumulative double bonds. Usually, $Ar^1$ is a group having from 1 to 10 aromatic rings, but the number of aromatic rings is preferably at most 3. $Ar^1$ may be an aromatic hydrocarbon group or an aromatic heterocyclic group. The aromatic hydrocarbon group may be a group made of an aromatic ring such as phenylene, naphthylene or anthrylene, or a group made of a condensed ring of an aromatic ring such as a bivalent group of indene such as indenylene, a bivalent group of fluorene or a bivalent group of tetralin, with another hydrocarbon ring. Whereas, the aromatic heterocyclic group may be a single cyclic aromatic heterocyclic group such as a bivalent group of furan, a bivalent group of thiophene or a bivalent group of pyrrole, or a composite aromatic heterocyclic group such as a bivalent group of quinoline, a bivalent group of chromene or a bivalent group of carbazole.

More specifically, p-phenylene, m-phenylene, 1,3-naphthylene or 1,4-naphthylene may, for example, be mentioned, but with a view to compacting the molecular size as far as possible to minimize intramolecular steric repulsion, p-phenylene or m-phenylene is preferred. For the purpose of improving the electrical characteristics, p-phenylene is preferred, and in a case where there is a problem in solubility, m-phenylene is preferred.

The substituent which $Ar^1$ may have, may, for example, be an alkyl group such as a methyl group, an ethyl group or a propyl group; an alkenyl group such as an allyl group; an alkoxy group such as a methoxy group, an ethoxy group or a propoxy group; or an aryl group such as a phenyl group. Such a substituent has an effect to increase the charge mobility by an electron donative effect, but if the size of the substituent tends to be too large, the charge mobility tends to be rather reduced by distortion of intramolecular conjugate plains or by intermolecular steric repulsion. Accordingly, it is preferably one having at most 10 carbon atoms, particularly preferably one having at most three carbon atoms, and among them, a methyl group or a methoxy group is preferred.

Likewise, if the number of substituents in one $Ar^1$ is too large, the charge mobility tends to be reduced for the same reason. Accordingly, the number of substituents is preferably at most 3, more preferably at most 2. Further, if the total number of substituents which from 3 to 6 $Ar^1$ may have as a whole, is too large, the charge mobility will be reduced for the same reason. Accordingly, such total number is preferably at most 8, more preferably at most 6. Particularly preferably, there is no substituent so long as there is no problem in the solubility or electrical characteristics. Further, such substituents may form a ring in the molecule via a connecting group or by direct bonding.

Further, the charge transport material represented by the formula (1) has from 3 to 6 $Ar^1$ in the same molecule, and such a plurality of $Ar^1$ may have different structures from one another.

In the formula (1), n is an integer of from 3 to 6. When n is 5 or 6, it is preferred that at least one of $Ar^1$ in the same molecule contains a m-phenylene group, or the adjacent groups of $Ar^1$ together form a ring to form a condensed polycyclic structure. From the viewpoint of the production efficiency, n is preferably 3 or 4. In a case where n is 3, it is particularly preferred that all of $Ar^1$ are p-phenylene groups.

In the formula (1), each of $Ar^2$, $Ar^3$, $Ar^4$ and $Ar^5$ represents an aryl group, but may be any group so long as it is a group having an aromatic nature, and it may, for example, be a group having a so-called aromatic ring containing the largest number of non-cumulative double bonds. Usually, each of $Ar^2$, $Ar^3$, $Ar^4$ and $Ar^5$ is a group having from 1 to 10 aromatic rings, but the number of aromatic rings is preferably at most 3.

Each of $Ar^2$, $Ar^3$, $Ar^4$ and $Ar^5$ may be an aromatic hydrocarbon group or an aromatic heterocyclic group. The aromatic hydrocarbon group may be a group made of an aromatic ring such as phenyl, naphthyl or anthryl, or a group made of a condensed ring of an aromatic ring such as a monovalent ring of indene such as indenyl, a monovalent group of fluorene, such as fluorenyl or a monovalent group of tetralin, with another hydrocarbon ring. Further, the aromatic heterocyclic group may be a single cyclic aromatic heterocyclic group such as a monovalent group of furan, a monovalent group of thiophene or a monovalent group of pyrrol, or a composite aromatic heterocyclic group such as a monovalent group of quinoline, a monovalent group of chromene or a monovalent group of carbazole.

Specific examples of $Ar^2$, $Ar^3$, $Ar^4$ and $Ar^5$ may, for example, be a phenyl group, a naphthyl group, an acenaphthyl group, an indenyl group, a fluorenyl group, a pyrenyl group or a thienyl group. Among them, a phenyl group, a naphthyl group or a thienyl group is preferred with a view to expansion of intramolecular conjugate or reduction of the permanent dipole moment of the molecule.

The substituent which $Ar^2$, $Ar^3$, $Ar^4$ and $Ar^5$ may have, may, for example, be an alkyl group such as a methyl group, an ethyl group or a propyl group; an alkenyl group such as allyl group; an aralkyl group such as a benzyl group; an aryl group such as a phenyl group or a tolyl group; or an alkoxy group such as a methoxy group, an ethoxy group or a propoxy group. Such a substituent has an effect to improve the intramolecular charge balance thereby to increase the charge mobility, but if the size of the substituent becomes too large, the charge mobility tends to be rather reduced by a distortion of intramolecular conjugate plains or by the intermolecular steric repulsion. Accordingly, it is preferably one having at most 3 carbon atoms, particularly preferably one having at most 2 carbon atoms, and among them, a methyl group or a methoxy group is particularly preferred.

Likewise, if the number of substituents is too large, the charge mobility will be reduced for the same reason, and the number of substituents is preferably at most 3, more preferably at most 2. Particularly preferably, there is no substituent so long as there is no problem in the solubility or electrical characteristics. Further, these substituents may form a ring in the molecule via a connecting group or by direct bonding. Further, among $Ar^2$, $Ar^3$, $Ar^4$ and $Ar^5$, at least one preferably has at least one substituent. Further, such substituents may form a ring in the molecule via a connecting group or by direct bonding.

A usual method for producing the charge transport material of the formula (1) is not particularly limited, but preferably, it may be obtained by using a known reaction such as an Ullmann reaction of a secondary amine with a halogenated aryl compound.

Now, specific examples of the formula (1) to be used in the present invention will be shown below.

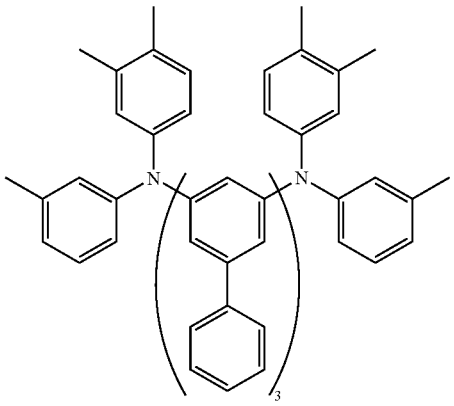

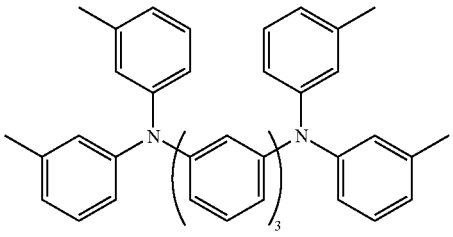

-continued
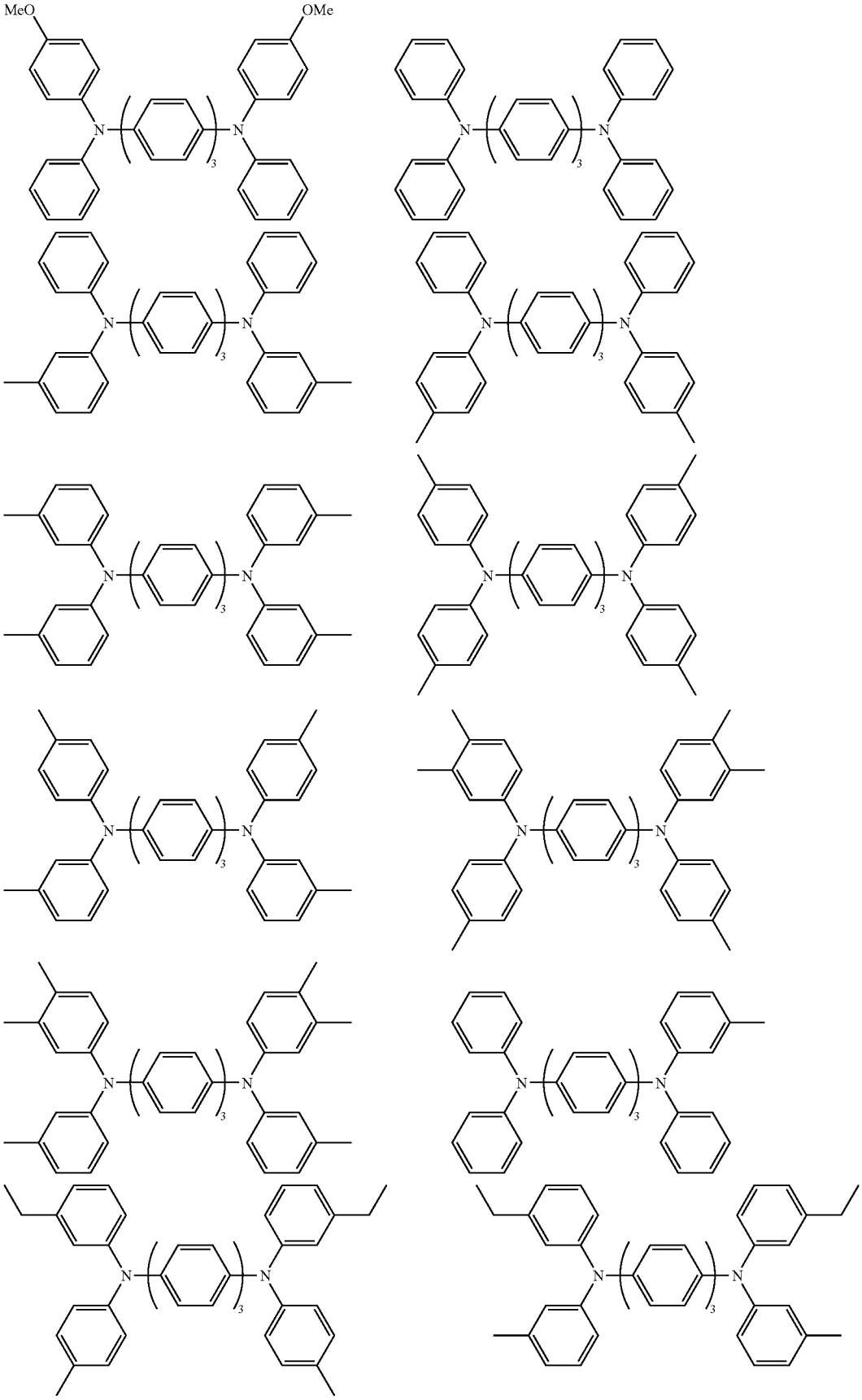

-continued
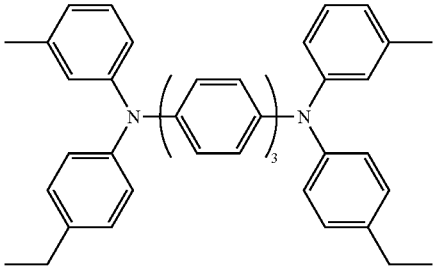
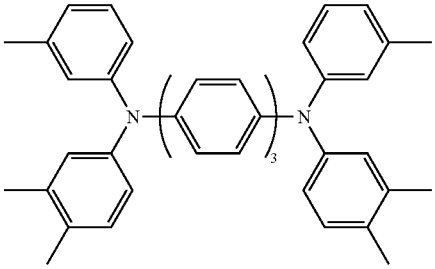
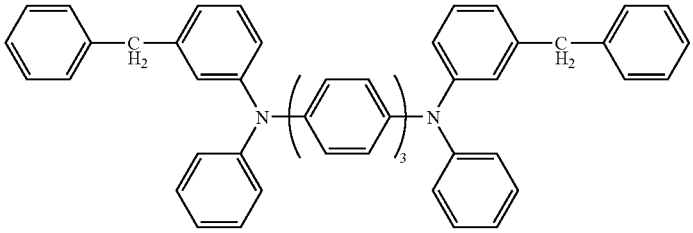
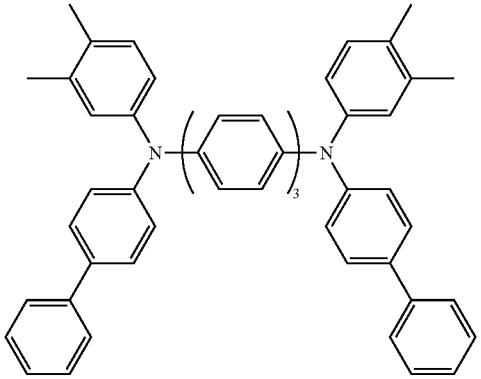
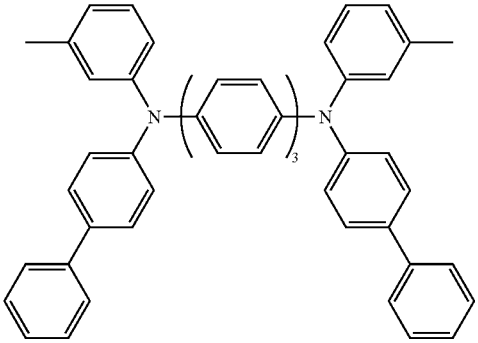
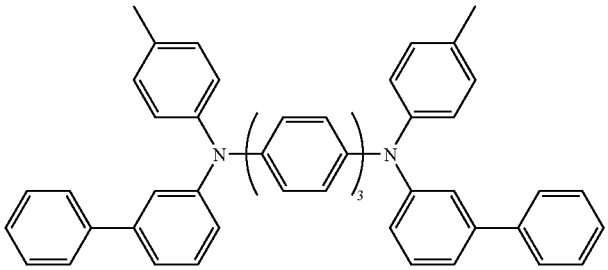
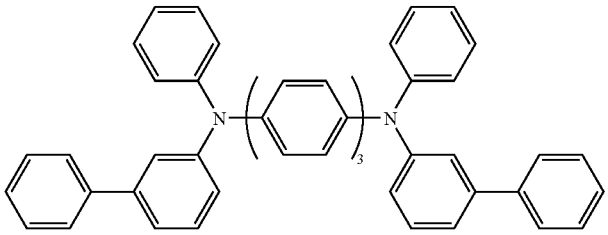
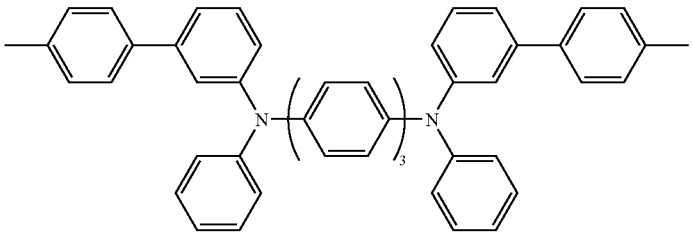

-continued
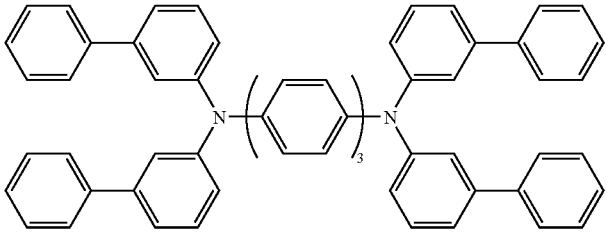
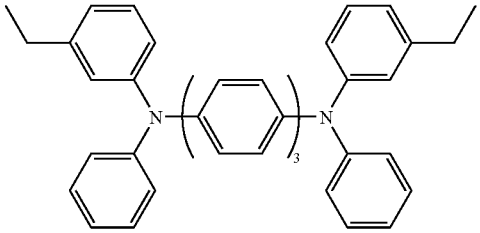
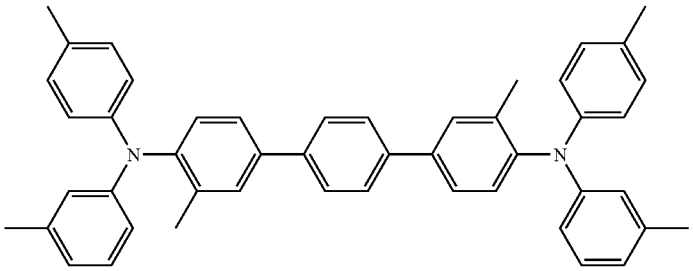
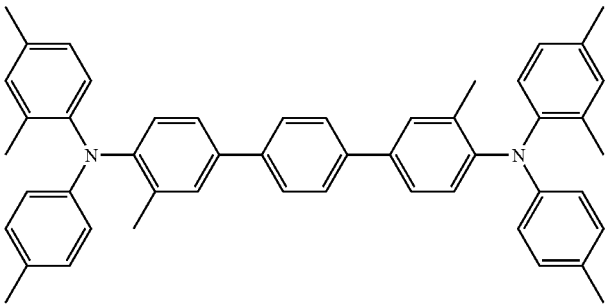
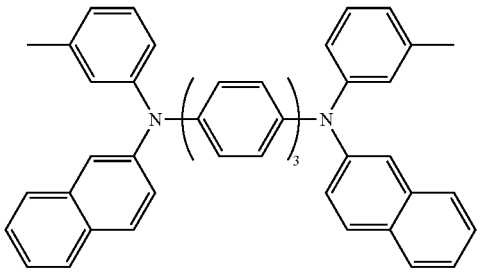
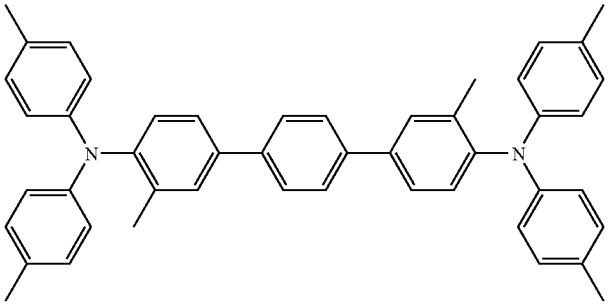
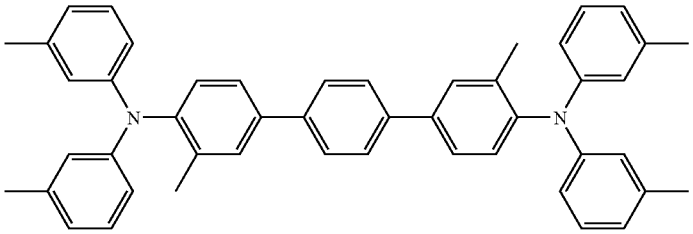
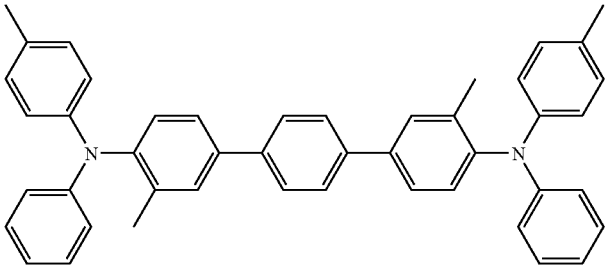

-continued
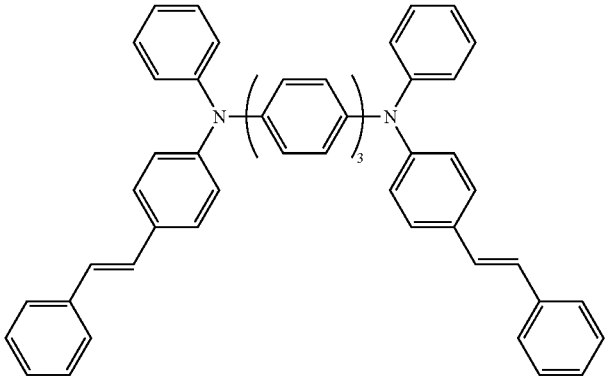
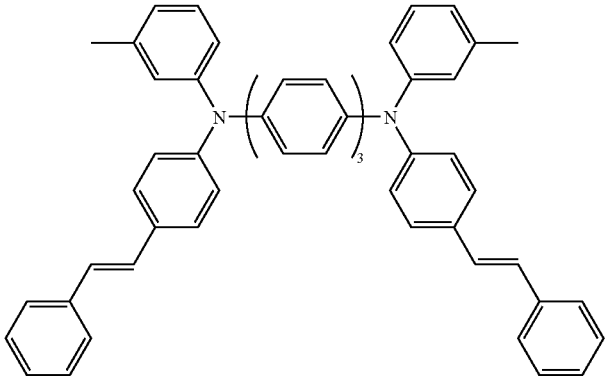
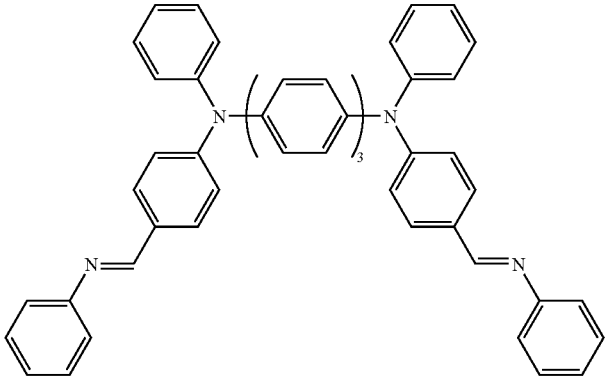
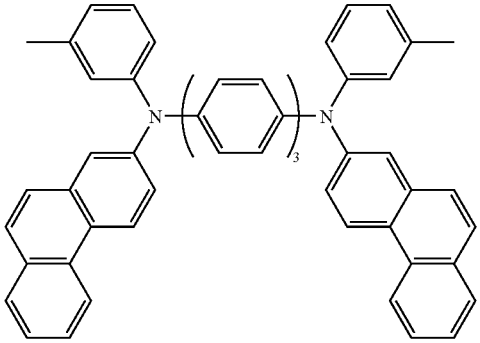
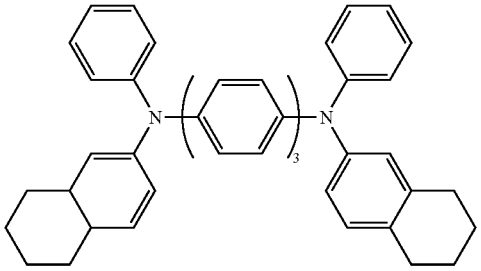
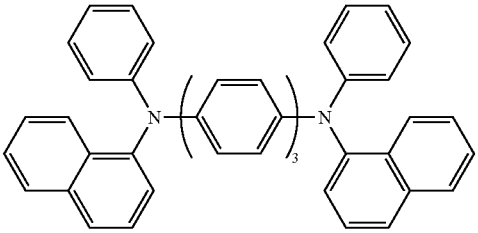

-continued
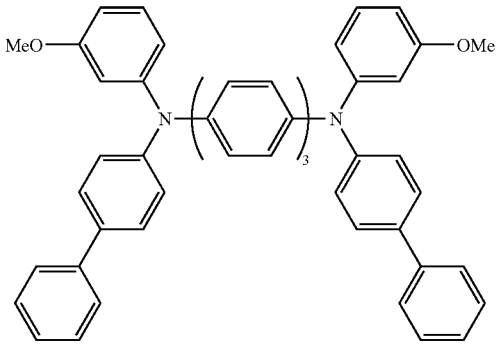
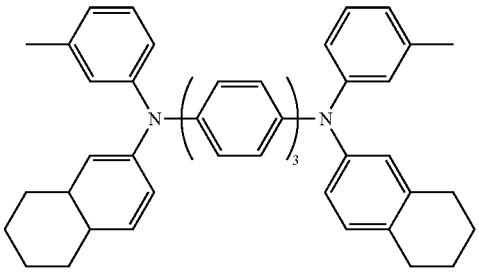
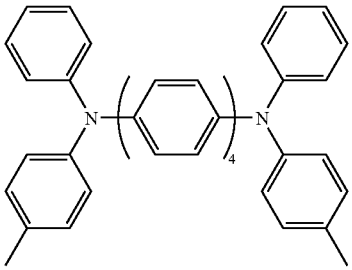
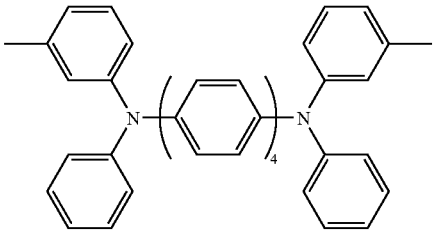
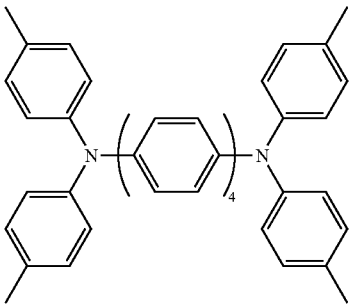
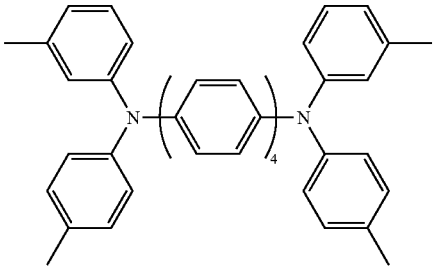
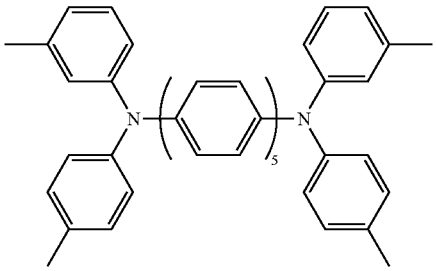
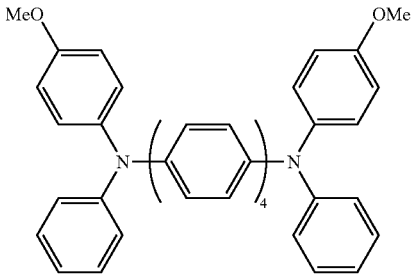
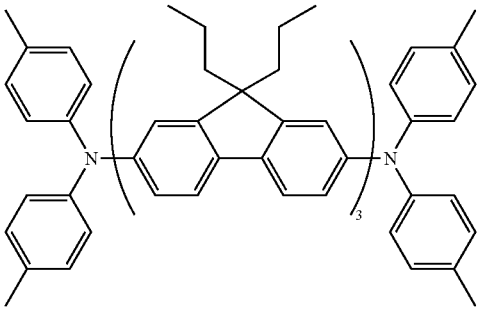
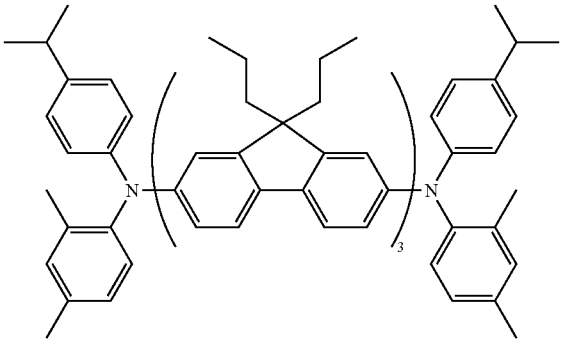

-continued

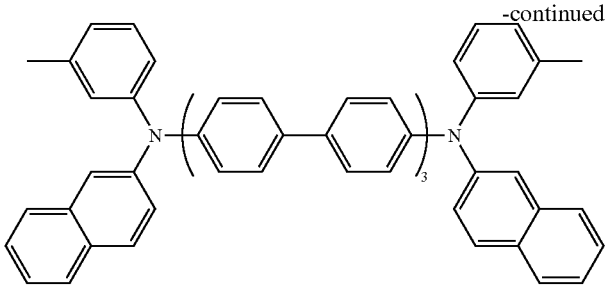

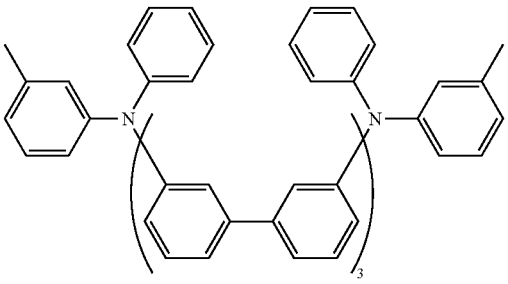

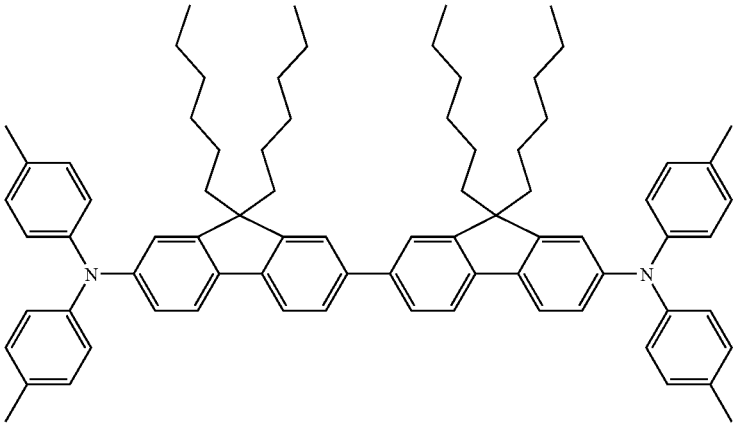

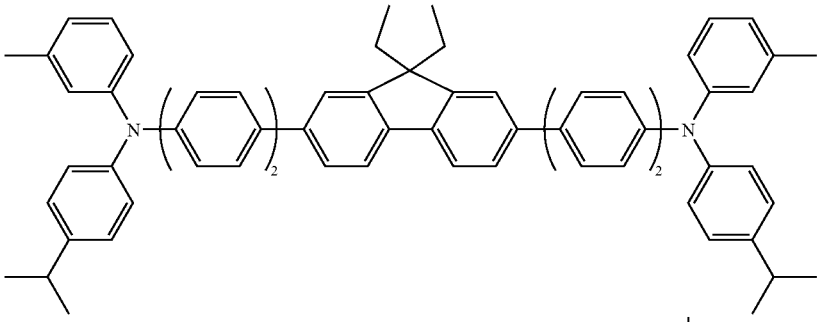

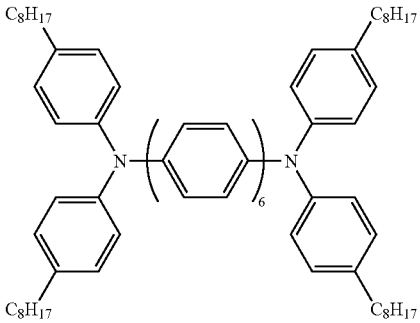

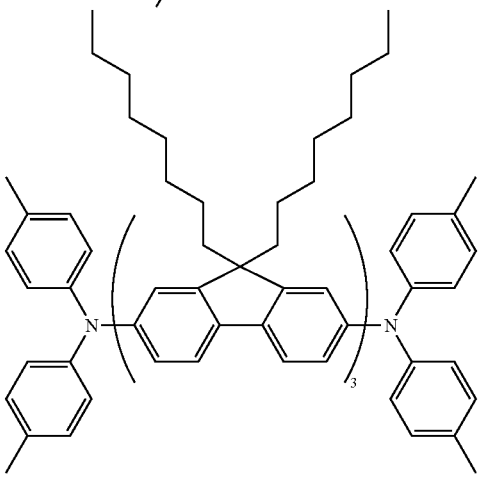

The charge transport layer of the electrophotographic photoreceptor of the present invention contains a binder resin. The binder resin may, for example, be a polymer or copolymer of a vinyl compound such as butadiene, styrene, vinyl acetate, vinyl chloride, an acrylic ester, a methacrylic ester, vinyl alcohol or ethyl vinyl ether, polyvinyl butyral, polyvinyl formal, partially modified polyvinyl acetal, polycarbonate, polyester, polyarylate, polyamide, polyurethane, cellulose ether, a phenoxy resin, a silicon resin, an epoxy resin or a poly-N-vinylcarbazole resin. Among them, polycarbonate or polyarylate is particularly preferred. Further, such binders may be used as crosslinked by heat, light or the like by using a suitable curing agent or the like. Two or more of such binder resins may be used as blended. The binder resin will be described in detail hereinafter.

The ratio of the charge transport material represented by the formula (1) to the binder is at least 5 parts by mass per 100 parts by mass of the binder resin. Further, with a view to reducing the residual potential, it is preferably at least 10 parts by mass, and from the viewpoint of the stability in repeated use or the charge mobility, it is more preferably at least 20 parts by mass. On the other hand, it is usually at most 45 parts by mass from the viewpoint of thermal stability of the photosensitive layer, preferably at most 40 parts by mass from the viewpoint of the compatibility between the charge transport material and the binder resin, further preferably at most 35 parts by mass from the viewpoint of printability, most preferably at most 30 parts by mass from the viewpoint of scratch resistance.

In the charge transport layer, a plurality of charge transport materials represented by the formula (1) may be contained. In such a case, the above "ratio of the charge transport material represented by the formula (1)" means the ratio of the total mass of all charge transport materials represented by the formula (1) in the charge transport layer.

Further, a combined use of a charge transport material other than the charge transport material represented by the formula (1) is preferred for the purpose of forming good image. In a case where a plurality of charge transport materials are contained in the charge transport layer, the mass of the total charge transport materials contained in the charge transport layer is preferably at least 25 parts by mass per 100 parts by mass of the binder resin, and it is more preferably at least 30 parts by mass with a view to reducing the residual potential, more preferably at least 40 parts by mass from the viewpoint of the stability in repeated use or charge mobility. On the other hand, it is usually at most 55 parts by mass from the viewpoint of thermal stability of the photosensitive layer, preferably at most 50 parts by mass from the viewpoint of compatibility between the charge transport material and the binder resin, more preferably at most 35 parts by mass from the viewpoint of printability, most preferably at most 45 parts by mass from the viewpoint of scratch resistance.

Here, the above "plurality of charge transport materials" may be a plurality of charge transport materials represented by the formula (1) or may be "a plurality" in a combined use with "other charge transport materials" other than the charge transport material represented by the formula (1).

Here, "other charge transport materials" to be combined with the charge transport material represented by the formula (1) may be any materials so long as they have charge transport ability. The following may be mentioned as preferred examples.

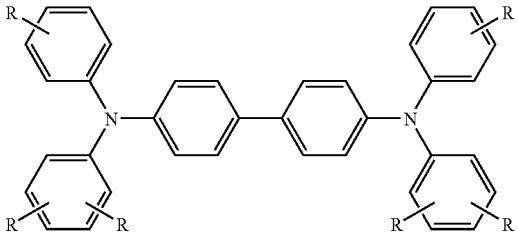

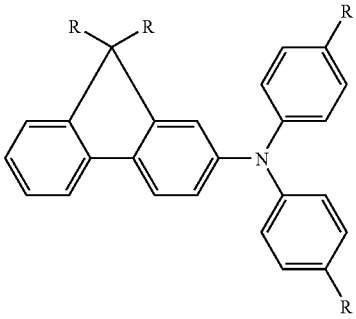

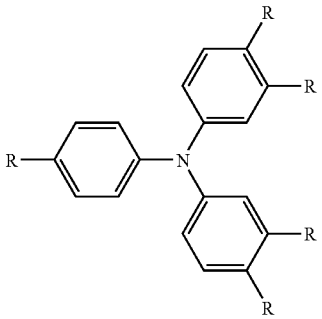

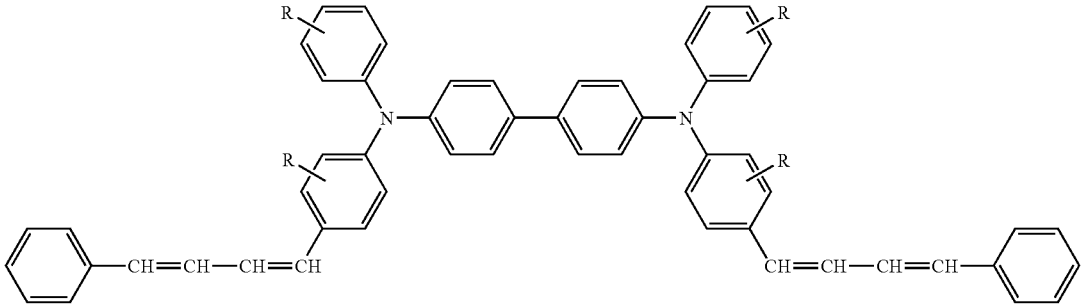

-continued

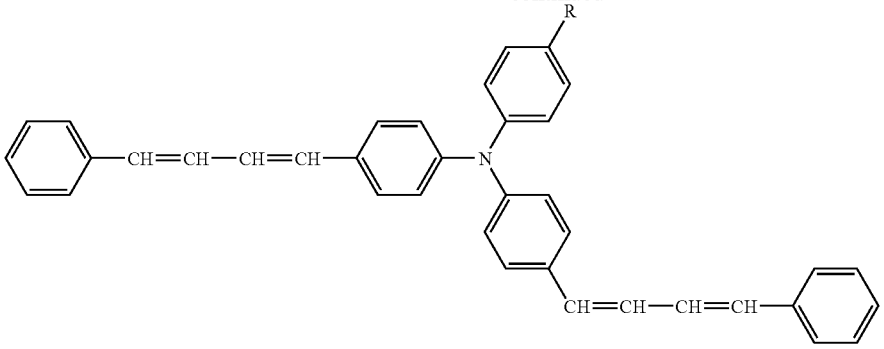

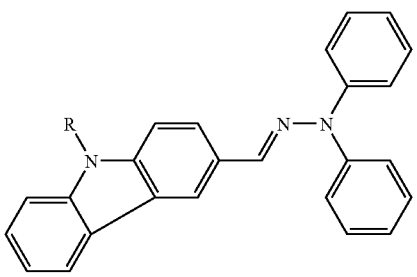

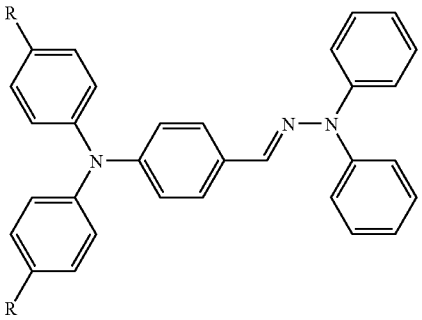

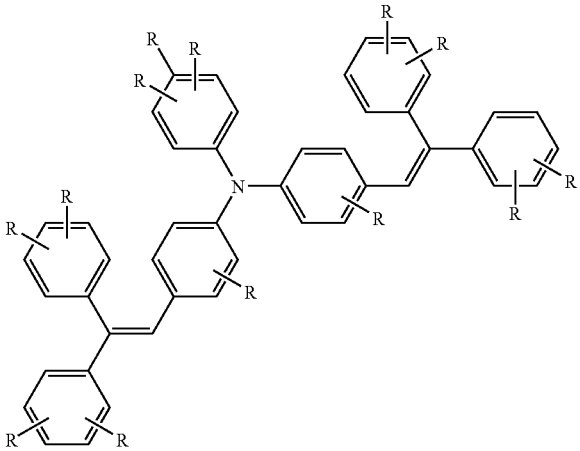

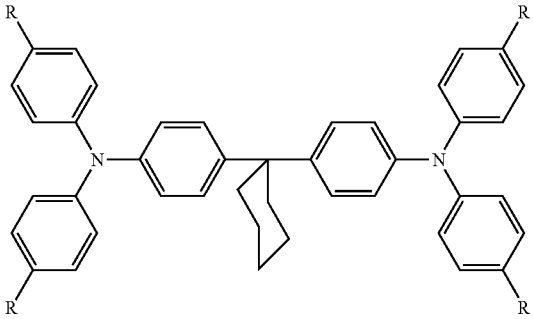

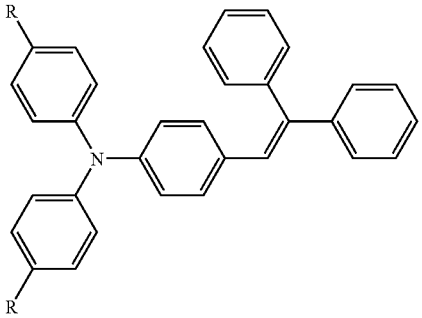

In all of the structural formulae of the above exemplified "other charge transport materials", each R independently represents a hydrogen atom or a substituent. The substituent may, for example, be preferably an alkyl group, an alkoxy group or a phenyl group. Particularly preferred is a methyl group.

(Electroconductive Substrate)

As the electroconductive substrate, a metallic materials such as aluminum, an aluminum alloy, stainless steel, copper or nickel; a resin material having a conductive powder such as a metal, carbon or tin oxide added to impart electroconductivity; a resin, glass or paper with an electroconductive material such as aluminum, nickel or ITO (indium tin oxide) deposited or coated on its surface, may, for example, be mainly used. It is used in a drum form, sheet form, belt form, or the like. An electroconductive substrate made of a metallic material coated with an electroconductive material having an appropriate resistance value for controlling e.g. the conductivity and the surface properties, or covering the defects, may also be used.

In a case where a metallic material such as an aluminum alloy is used as the electroconductive substrate, it is preferably used after subjected to an anodic oxidation treatment. When it is subjected to the anodic oxidation treatment, it is preferably subjected to a sealing treatment by a known method. The substrate surface may be either smooth, or roughened by using a particular cutting method or carrying out a polishing treatment. Further, it may also be one roughened by mixing particles with an appropriate particle size in the material constituting the substrate. Further, to lower the cost, a drawn tube without cutting treatment may be used as it is.

An undercoat layer may be provided between the electroconductive substrate and the photosensitive layer for improving the adhesion, the blocking tendency, etc.

As the undercoat layer, a resin, one obtained by dispersing particles of a metal oxide or the like in a resin, or the like is used.

Examples of the metal oxide particles to be used for the undercoat layer include particles of a metal oxide containing one metallic element such as titanium oxide, aluminum oxide, silicon oxide, zirconium oxide, zinc oxide or iron oxide; and particles of a metal oxide containing a plurality of metallic elements such as calcium titanate, strontium titanate and barium titanate. These particles may be used singly or as a mixture of a plurality thereof. Among such metallic oxide particles, titanium oxide or aluminum oxide is preferred, and titanium oxide is particularly preferred. The titanium oxide particles may be surface-treated by an inorganic substance such as tin oxide, aluminum oxide, antimony oxide, zirconium oxide or silicon oxide, or an organic substance such as stearic acid, polyol or silicone. Any crystalline form of the titanium oxide particles such as rutile-, anatase-, brookite-, or amorphous-form may be used. A plurality of crystalline forms may also be included therein.

Further, the particle sizes of the metal oxide particles usable may be various ones. However, when an average value of the maximum sizes of particles as observed by SEM photographs in optional 10 times is taken as the average primary particle size, the average primary particle size is preferably at least 10 nm and at most 100 nm, particularly preferably at least 10 nm and at most 50 nm in view of the characteristics and the solution stability.

The undercoat layer is preferably formed into such a structure that the metal oxide particles are dispersed in a binder resin. Examples of the binder resin to be used for the undercoat layer include phenoxy, epoxy, is polyvinylpyrrolidone, polyvinyl alcohol, casein, polyacrylic acid, celluloses, gelatin, starch, polyurethane, polyimide and polyamide, and they can be used respectively alone or in a cured form with a curing agent. Among them, alcohol-soluble copolymerized polyamide, modified polyamide or the like is preferred in that it exhibits good dispersibility and coating property.

The blend ratio of the inorganic particles to the binder resin to be used for the undercoat layer can be optionally selected, but it is preferably in the range of from 10 mass % to 500 mass % to the entire binder resin in view of the stability and the coating property of the dispersion liquid.

The thickness of the undercoat layer can be optionally selected, but it is preferably in a range of from 0.1 μm to 20 μm in view of the photoreceptor characteristics and the coating property. Further, a known antioxidant or the like may also be incorporated to the undercoat layer.

(Photosensitive Layer)

As the construction of the photosensitive layer of the electrophotographic photoreceptor of the present invention, any construction applicable to a known electrophotographic photoreceptor, which has a charge transport layer containing a charge transport material, may be employed. Particularly, a so-called lamination type photoreceptor may, for example, be mentioned wherein a charge generation layer containing a charge generation material and a charge transport layer containing a charge transport material are laminated to have a photosensitive layer comprising a plurality of layers. More preferred is a sequential lamination type photoreceptor wherein a charge generation layer and a charge transport layer are laminated in this order on an electroconductive substrate.

(Charge Generation Material)

As the charge generation material, selenium and alloys thereof, cadmium sulfide, and other inorganic photoconductive materials, and various photoconductive materials including organic pigments such as phthalocyanine pigments, azo pigments, dithioketopyrrolopyrrole pigments, squalene (squarylium) pigments, quinacridone pigments, indigo pigments, perylene pigments, polycyclic quinone pigments, anthanthrone pigments and benzimidazole pigments may be used. The organic pigments are particularly preferred, and phthalocyanine pigments and azo pigments are more preferred.

The fine particles of these photoconductive materials are used as bound by various binder resins such as polyester resin, polyvinyl acetate, polyacrylic acid ester, polymethacrylic acid ester, polyester, polycarbonate, polyvinyl acetoacetal, polyvinyl propional, polyvinyl butyral, phenoxy resin, epoxy resin, urethane resin, cellulose ester and cellulose ether. In the case of the lamination type photoreceptor, the amount of the photoconductive material to be used is within a range of from 30 to 500 parts by mass, per 100 parts by mass of the binder resin, and the thickness is usually within a range of from 0.1 μm to 1 μm, preferably within a range of from 0.15 μm to 0.6 μm.

(Phthalocyanine Compound)

In a case where a phthalocyanine compound is used as the charge generation material, specifically, metal-free phthalocyanine; phthalocyanines of metals such as copper, indium, gallium, tin, titanium, zinc, vanadium, silicon and germanium, or oxides of such metals; or various crystal forms of phthalocyanines having halides, hydroxides, alkoxides or the like coordinated, may be used. Particularly, high-sensitivity crystal form X-form, τ-form metal-free phthalocyanines; A-form (alias β-form), B-form (alias α-form), D-form (alias Y-form) or the like of oxytitanium phthalocyanine (alias oxytitanium phthalocyanine); vanadyl phthalocyanine; chloroindium phthalocyanine; II-type or the like of chlorogallium phthalocyanine; V-type or the like of hydroxygallium phthalocyanine; G-type, I-type or the like of μ-oxo-gallium phthalocyanine dimer; or II-type or the like of μ-oxo-aluminium phthalocyanine dimer is preferred. Among these phthalocyanines, particularly preferred are A-form (β-form), B-form (α-form) and D-form (Y-form) showing a distinct peak at a Bragg angle (2θ±0.2°) of 27.3° in powder X-ray diffraction spectrum to CuKα characteristic X-ray, of oxytitanium phthalocyanine, II-type of chlorogallium phthalocyanine, V-type of hydroxygallium phthalocyanine, and G-type of μ-oxo-gallium phthalocyanine dimmer. Among them, more preferred is D-form oxytitanium phthalocyanine showing peaks at Bragg angles (2θ±0.2°) of 9.5°, 24.1° and 27.3° in X-ray diffraction spectrum to CuKα characteristic X-ray, since it is excellent in compatibility in combination with various charge transport materials. Further, in the present invention, the D-form oxytitanium phthalocyanine is particularly preferably one prepared by an acid paste treatment with sulfuric acid.

Chlorooxytitanium phthalocyanine contained in the D-form oxytitanium phthalocyanine should preferably be small in amount. Namely, preferred is one containing chlorooxytitanium phthalocyanine in an amount of at most 0.005 based on oxytitanium phthalocyanine by the intensity ratio in the method (mass spectrum method) as disclosed in JP-A-2001-115054. Further, it is preferred to use a material prepared by using a non-halogen compound.

The phthalocyanine compounds may be used alone or in a mixed state or in a mixed crystal state of some of them. The phthalocyanine compounds in a mixed state or mixed crystal state may be obtained by preparing the respective phthalocyanine compounds independently and then mixing them, or by causing the mixed state in the manufacturing and treatment process of the phthalocyanine compounds, such as preparation, formation into pigment or crystallization. As such treatment, an acid paste treatment, a grinding treatment, a solvent treatment or the like is known. To cause a mixed crystal state, a method may be mentioned which comprises mixing two type of crystals, mechanically grinding the mixture into an undefined form, and then converting the mixture to a specific crystal state by a solvent treatment, as disclosed in JP-A-10-48859.

(Oxytitanium Phthalocyanine Obtainable by Chemical Treatment, Followed by Contact with Organic Solvent)

The charge generation layer of the electrophotographic photoreceptor of the present invention preferably contains a specific oxytitanium phthalocyanine. Such an oxytitanium phthalocyanine is obtained by chemical treatment of a phthalocyanine precursor, followed by contact with an organic solvent. Hereinafter, such an oxytitanium phthalocyanine will be referred to as "the specific oxytitanium phthalocyanine".

In the present invention, chemical treatment is treatment used at a stage of preparing amorphous oxytitanium phthalocyanine or low-crystalline oxytitanium phthalocyanine. Chemical treatment is not a method to is obtain amorphous oxytitanium phthalocyanine or low-crystalline oxytitanium phthalocyanine merely by using a physical force (such as mechanical pulverization or the like) but a treating method to obtain amorphous or low-crystalline oxytitanium phthalocyanine by using a chemical phenomenon such as dissolution, a reaction or the like.

As specific examples of chemical treatment, chemical treatment methods may be mentioned such as an acid pasting method (in this specification, "an acid pasting method" may sometimes be referred to simply as "an acid paste method") which is carried out by dissolving a phthalocyanine precursor in a strong acid, an acid slurry method which is carried out via a dispersed state in a strong acid, and a method wherein phenol or an alcohol is added to dichlorotitanyl phthalocyanine and then detached. Among them, in order to obtain amorphous or low-crystalline oxytitanium phthalocyanine constantly, an acid paste method or an acid slurry method is preferred, and an acid paste method is more preferred.

The acid paste method or the acid slurry method is a method to modify a pigment, wherein the pigment is dissolved, suspended or dispersed in a strong acid to prepare a solution, and the prepared solution is discharged into a medium which can be uniformly mixed with the strong acid and wherein the pigment will not substantially be dissolved (for example, in the case of oxytitanium phthalocyanine, water, an alcohol such as methanol, ethanol, propanol or ethylene glycol; or an ether such as ethylene glycol monomethyl ether, ethylene glycol diethyl ether or tetrahydrofuran), to reform and thereby modify the pigment.

In the acid slurry method or the acid paste method, a strong acid is used such as concentrated sulfuric acid, an organic sulfonic acid, an organic phosphonic acid or a trihalogenated acetic acid. These strong acids may be used alone individually or as a mixture of such strong acids, or in combination of a strong acid with an organic solvent. As the type of the strong acid, in view of the solubility of the phthalocyanine precursor, trihalogenated acetic acid or concentrated sulfuric acid is preferred, and in view of the production cost, concentrated sulfuric acid is more preferred.

With respect to the concentration of concentrated sulfuric acid, in view of the solubility of the phthalocyanine precursor, concentrated sulfuric acid of at least 90 mass % is preferred, and more preferred is concentrated sulfuric acid of at least 95 mass %, because if the content of concentrated sulfuric acid is low, the production efficiency tends to be low.

With respect to the temperature for dissolving the phthalocyanine precursor in the strong acid, it may be dissolved under the temperature condition disclosed in a known literature. However, if the temperature is too high, the phthalocyanine ring of the precursor is likely to undergo ring-opening and decomposition, and accordingly, the temperature is preferably at most 5° C., and in consideration of the influence over the obtainable electrophotographic photoreceptor, it is more preferably at most 0° C.

The strong acid may be used in an optional amount. However, if it is too small, the solubility of the phthalocyanine precursor tends to be poor, and the amount of the strong acid is at least 5 parts by mass per 1 part by mass of the phthalocyanine precursor, and if the solid content in the solution is too high, the stirring efficiency tends to deteriorate, and accordingly, it is preferably at least 15 parts by mass, more preferably at least 20 parts by mass. On the other hand, if the amount of the strong acid is too large, the amount of waste acid will increase, and it is preferably at most 100 parts by mass, and in consideration of the production efficiency, it is more preferably at most 50 parts by mass.

The type of the medium into which the obtained acid solution of the phthalocyanine precursor is discharged, may, for example, be water; a monohydric alcohol such as methanol, ethanol, 1-propanol or 2-propanol; a polyhydric alcohol such as ethylene glycol or glycerol; a cyclic ether such as tetrahydrofuran, dioxane, dioxolane or tetrahydrofuran; or a linear ether such as ethylene glycol monomethyl ether or ethylene glycol diethyl ether. In the same manner as a known method, such media may be used alone or in combination as a mixture of two or more of them. Depending upon the medium to be used, the particle shape, the crystallized shape, etc. of the re-formed pigment may change, and such history may influence subsequently obtainable final crystals of electrophotographic photoreceptor. Accordingly, the medium is preferably water or a lower alcohol such as methanol, ethanol, 1-propanol or 2-propanol, and from the viewpoint of the productivity and costs, water is more preferred.

The re-formed pigment oxytitanium phthalocyanine obtained by discharging the concentrated sulfuric acid solution of the phthalocyanine precursor into the medium, will be collected as a wet cake by filtration. However, this wet cake contains a large amount of impurities such as sulfuric acid ions of concentrated sulfuric acid present in the medium. Therefore, the re-formed pigment is cleaned with a cleaning medium. The cleaning medium may, for example, be an aqueous alkaline solution such as an aqueous sodium hydroxide solution, an aqueous potassium hydroxide solution, an aqueous sodium hydrogen carbonate solution, an aqueous sodium carbonate solution, an aqueous potassium carbonate solution, an aqueous sodium acetate solution or an aqueous ammonia solution; an aqueous acidic solution such as dilute hydrochloric acid, dilute nitric acid or dilute acetic acid; or water such as deionized water. Among them, water having ionic substances removed, such as deionized water, is preferred, because ionic substances remaining in the pigment may adversely affect the characteristics of the electrophotographic photoreceptor in many cases.

Usually, the oxytitanium phthalocyanine obtainable by the acid paste method or the acid slurry method is an amorphous one having no distinct diffraction peak or a low crystalline one which has a peak, but its intensity is very weak and its half-value width is very large.

Usually, the amorphous oxytitanium phthalocyanine or the low-crystalline oxytitanium phthalocyanine obtained by the acid paste method or the acid slurry method is contacted with an organic solvent, whereby it is possible to obtain oxytitanium phthalocyanine having main diffraction peaks at Bragg angles) (2θ±0.2°) of 9.5°, 24.1° and 27.2° to CuKα characteristic X-ray (wavelength: 1.541 Å) or "the specific oxytitanium phthalocyanine" having main diffraction peaks at 9.5°, 9.7°, 24.2° and 27.2°, which can be used for the electrophotographic photoreceptor of the present invention.

The specific oxytitanium phthalocyanine is obtainable by the chemical treatment, followed by contact with the organic solvent. Here, the amorphous oxytitanium phthalocyanine and the low-crystalline oxytitanium phthalocyanine after the chemical treatment will be generally referred to as "low-crystalline is phthalocyanines".

In the present invention, "low-crystalline phthalocyanines" are meant for phthalocyanines having no peak having a half-value width of at most 0.30° within a range of a Bragg angle)(2θ±0.2°) of form 0 to 40° to CuKα characteristic X-ray (wavelength: 1.541 Å) in a powder X-ray diffraction (hereinafter sometimes referred to as "XRD") spectrum. While phthalocyanine molecules maintain a certain constant regularity or long term order in solid, if such a half value width is too small, control of the crystal form may deteriorate by contact with the organic solvent to obtain the specific oxytitanium phthalocyanine. Accordingly, the low-crystalline phthalocyanine to be used in the present invention is preferably one showing no peak having its half value width of usually at most 0.35°, preferably at most 0.40°, particularly preferably at most 0.45°.

In this specification, the measurement of the powder X-ray diffraction spectrum of a phthalocyanine, determination of the Bragg angles) (2θ±0.2°) to CuKα characteristic X-ray (wavelength: 1.541 Å) and calculation of the peak half-value width, are carried out under the following conditions.

As the powder X-ray diffraction spectrum-measuring device, an integrated optical system powder X-ray diffraction meter (such as PW1700, manufactured by PANalytical) using CuKα (CuKα1+CuKα2) ray as the X-ray source, is used.

The conditions for measuring the powder X-ray diffraction spectrum are a scan range (2θ) of from 3.0 to 40.0°, a scan step width of 0.05°, a scan speed of 3.0°/min, a diffusing slit of 1°, a scanning slit of 1° and a light-receiving slit of 0.2 mm.

The peak half-value width can be calculated by a profile fitting method. The profile fitting can be carried out, for example, by using the X-ray diffraction pattern-analyzing soft JADE5.0+, manufactured by MDI.

The calculation conditions are as follows.

Firstly, the background is fixed at an ideal position from the entire measuring range (2θ=3.0 to 40.0°). As the fitting function, a Peason-VII function is used taking the contribution of CuKα2 into consideration. As the variables of the fitting function, three i.e. the diffraction angle (2θ), the peak height and the peak half-value width ($\beta_O$) will be refined. Namely, by removing the influence of CuKα2, the diffraction angle (2θ), the peak height and the peak half-value width ($\beta_O$) derived from CuKα1 are calculated. And, asymmetry is fixed to be 0, and the form-constant is fixed to be 1.5.

The peak half-value width ($\beta_O$) calculated by the above profile fitting method is corrected in accordance with the following formula by a peak half value width (βsi) of the 111 peak)(2θ=28.442°) of standard Si (NIST Si 640b) calculated under the same measurement condition and the same profile fitting condition, to obtain the peak half-value width (β) attributable to the sample:

$$\beta = \sqrt{\beta_o^2 - \beta_{Si}^2}$$

The boundary between the amorphous oxytitanium phthalocyanine and the low-crystalline oxytitanium phthalocyanine is not distinct. However, in the present invention, it is possible to obtain the specific oxytitanium phthalocyanine by using either one as the raw material.

The crystal of the specific oxytitanium phthalocyanine shows main diffraction peaks at Bragg angles) (2θ±0.2°) of 9.5°, 24.1° and 27.2° or 9.5°, 9.7°, 24.2° and 27.2° to CuKα characteristic X-ray (wavelength: 1.541 Å). Particularly, a low-crystalline phthalocyanine showing a peak in the vicinity of 27.2° has a regularity similar to the above specific oxytitanium phthalocyanine to some extent, and is excellent in the crystal-form controllability to the specific crystal-form. In such a case, the low-crystalline phthalocyanine is usually one showing no peak having its half-value width of at most 0.30°, preferably one showing no peak having its half-value width of at most 0.35°, more preferably one showing no peak having its half-value width of at most 0.40°, further preferably one showing no peak having its half-value width of at most 0.45°.

On the other hand, in a case where a low-crystalline phthalocyanine showing no peak in the vicinity of 27.2° is used as a raw material for a specific oxytitanium phthalocyanine, the crystal-form controllability to the specific oxytitanium phthalocyanine having the above-mentioned specific crystal-form is low, and accordingly, a lower crystallinity is desired. In such a case, the low-crystalline phthalocyanine is usually one showing no peak having its half-value width of at most 0.30°, preferably one showing no peak having its half-value width of at most 0.50°, more preferably one showing no peak having its half-value width of at most 0.70°, further preferably one showing no peak having its half-value width of at most 0.90°.

Usually, the contact of the low-crystalline phthalocyanine with an organic solvent is carried out in the presence of water. As such water, water contained in the water-containing cake obtained by the acid paste method or the acid slurry method may be employed, or water other than the water contained in the water-containing cake may be added subsequently. Otherwise, the water-containing cake obtained after the acid paste method or the acid slurry method may be dried once, and at the time of the crystal-conversion, fresh water may be added. However, if the cake is dried, the affinity between the pigment and water tends to be low. Accordingly, it is preferred to use water contained in is the water-containing cake obtained by the acid paste method or the acid slurry method without drying the cake, or water is further added subsequently to the water contained in the water-containing cake.

The solvent useful for the crystal conversion may be a solvent compatible with water or a solvent not-compatible with water. Preferred examples of the solvent compatible with water include cyclic ethers such as tetrahydrofuran, 1,4-dioxane and 1,3-dioxolane. Whereas, preferred examples of the solvent not-compatible with water include aromatic hydrocarbon solvents such as toluene, naphthalene and methylnaphthalene; halogenated hydrocarbon solvents such as monochlorobenzene, dichlorobenzene, chlorotoluene, dichlorotoluene, dichlorofluorobenzene and 1,2-dichloroethane; and substituted aromatic solvents such as nitrobenzene, 1,2-methylenedioxybenzene and acetophenone. Among them, a cyclic ether; a halogenated hydrocarbon such as monochlorobenzene, 1,2-dichlorobenzene, dichlorofluorobenzene or dichlorotoluene; or an aromatic hydrocarbon solvent, is preferred, since the electrophotographic characteristics of the crystal thereby obtainable, are good. Among them, tetrahydrofuran, monochlorobenzene, 1,2-dichlorobenzene, 2,4-dichlorotoluene, dichlorofluorobenzene, toluene or naphthalene is, for example, more preferred from the viewpoint of the stability in dispersion of the obtained crystal.

The crystal obtained after the crystal conversion is subjected to a drying step. With respect to the drying method, such drying may be carried out by a known method such as air-circulation drying, heat drying, vacuum drying or freeze drying.

The crystal of the specific oxytitanium phthalocyanine obtained by the above process is a crystal showing main diffraction peaks at Bragg angles) (2θ±0.2°) of 9.5°, 24.1° and 27.2°, or 9.5°, 9.7°, 24.2° and 27.2°, to CuKα characteristic X-ray (wavelength: 1.541 Å). A crystal showing a peak in the vicinity of 26.2° as another diffraction peak, is inferior in the crystal stability when dispersed, and crystal is preferably one showing no peak in the vicinity of 26.2°. Among them, a crystal showing main diffraction peaks at 7.3°, 9.5°, 11.6°, 14.2°, 18.0°, 24.1° and 27.2°, or at 7.3°, 9.5°, 9.7°, 11.6°, 14.2°, 18.0°, 24.2° and 27.2°, is particularly preferred from the viewpoint of the residual potential and dark decay when used as an electrophotographic photoreceptor.

As shown by 2θ±0.2°, a Bragg angle has a margin of error of ±0.2°. Therefore, for example, "a Bragg angle (2θ±0.2°) of 9.5°" means a range of from 9.3° to 9.7°. This margin of error applies to other angles in the same manner.

(Azo Compound)

In a case where an azo compound is used as the charge generation material, various known bisazo pigments or trisazo pigments may suitably be used. As an azo compound suitable for the present invention, a compound having an oxadiazole ring structure is also preferred. Specific examples of suitable azo compounds will be shown below.

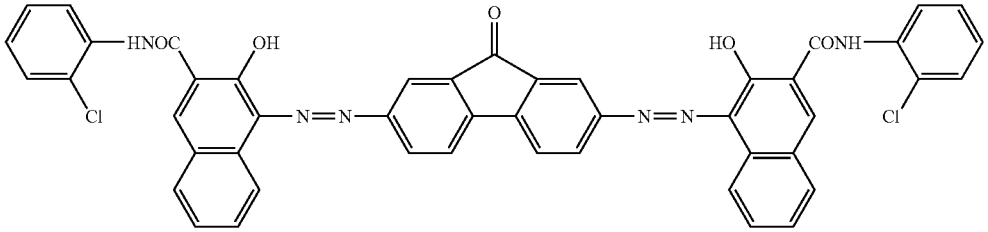

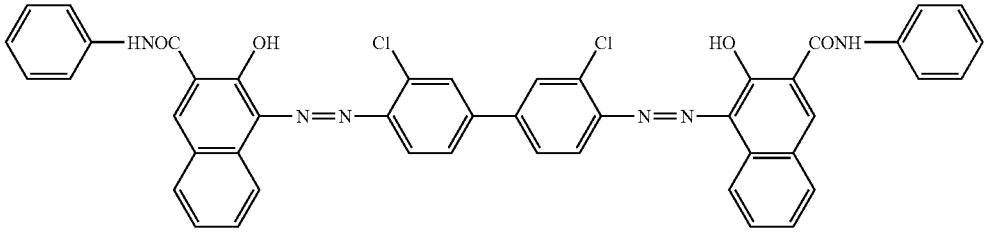

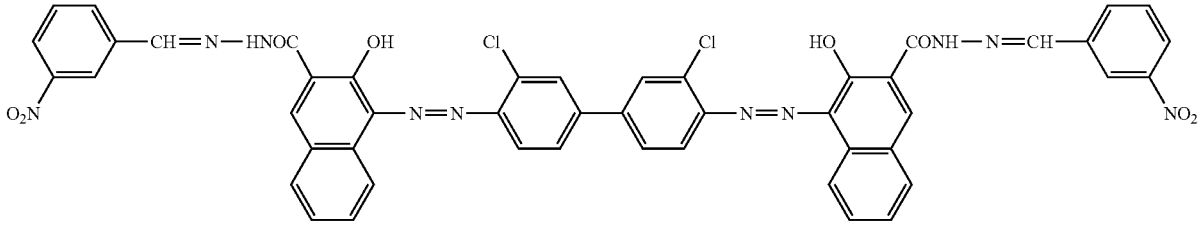

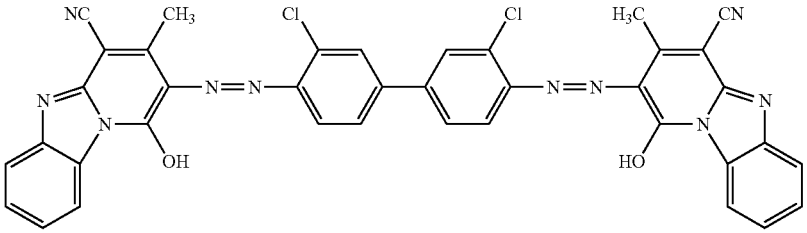

-continued

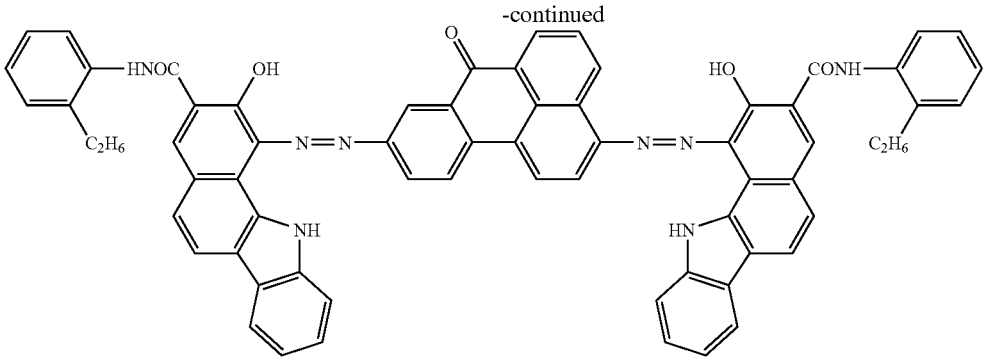

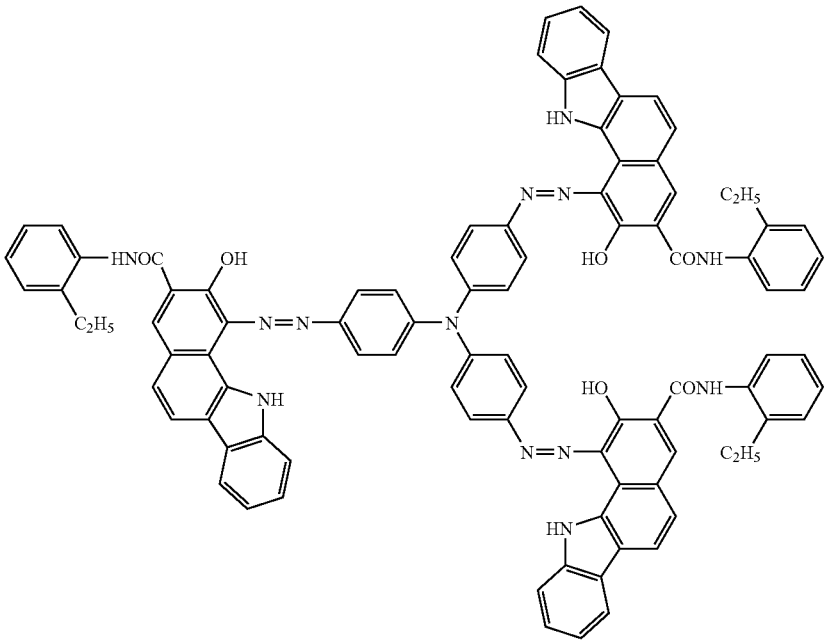

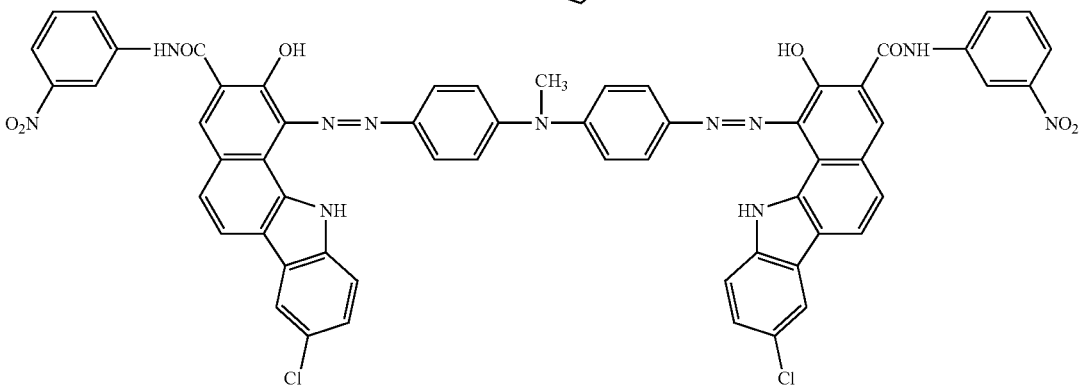

(Binder Resin)

At the time of forming a photosensitive layer, a binder resin is used to secure the film strength. In such a case, the photosensitive layer is obtained by applying a coating solution obtained by dissolving or dispersing a binder resin in a solvent together with the above-mentioned charge generation material or the like, on an electroconductive substrate (on an undercoat layer when such an undercoat layer is provided), followed by drying.

As a binder resin which is particularly preferably employed, a polycarbonate resin or a polyester resin may, for example, be mentioned. Such a resin usually has a partial structure of a diol component. As the diol component to form such a structure, a bisphenol residue or a biphenol residue may, for example, be mentioned.

A specific example of such a diol component may be a bisphenol component such as bis-(4-hydroxy-3,5-dimethylphenyl)methane, bis-(4-hydroxyphenyl)methane, bis-(4-hydroxy-3-methylphenyl)methane, 1,1-bis-(4-hydroxyphenyl)ethane, 1,1-bis-(4-hydroxyphenyl)propane, 2,2-bis-(4-hydroxyphenyl)propane, 2,2-bis-(4-hydroxy-3-methylphenyl)propane, 2,2-bis-(4-hydroxyphenyl)butane, 2,2-bis-(4-hydroxyphenyl)pentane, 2,2-bis-(4-hydroxyphenyl)-3-methylbutane, 2,2-bis-(4-hydroxyphenyl)hexane, 2,2-bis-(4-hydroxyphenyl)-4-methylpentane, 1,1-bis-(4-hydroxyphenyl)cyclopentane, 1,1-bis-(4-hydroxyphenyl)cyclohexane, bis-(3-phenyl-4-hydroxyphenyl)methane, 1,1-bis-(3-phenyl-4-hydroxyphenyl)ethane, 1,1-bis-(3-phenyl-4-hydroxyphenyl)propane, 2,2-bis-(3-phenyl-4-hydroxyphenyl)propane, 1,1-bis-(4-hydroxy-3-methylphenyl)ethane, 2,2-bis-(4-hydroxy-3-methylphenyl)propane, 2,2-bis-(4-hydroxy-3-ethylphenyl)propane, 2,2-bis-(4-hydroxy-3-isopropylphenyl)propane, 2,2-bis-(4-hydroxy-3-sec-butylphenyl)propane, 1,1-bis-(4-hydroxy-3,5-dimethylphenyl)ethane, 2,2-bis-(4-hydroxy-3,5-dimethylphenyl)propane, 1,1-bis-(4-hydroxy-3,5-dimethylphenyl)cyclohexane, 1,1-bis-(4-hydroxy-3,6-dimethylphenyl)ethane, bis-(4-hydroxy-2,3,5-trimethylphenyl)methane, 1,1-bis-(4-hydroxy-2,3,5-trimethylphenyl)ethane, 2,2-bis-(4-hydroxy-2,3,5-trimethylphenyl)propane, bis-(4-hydroxy-2,3,5-trimethylphenyl)phenylmethane, 1,1-bis-(4-hydroxy-2,3,5-trimethylphenyl)phenylethane, 1,1-bis-(4-hydroxy-2,3,5-trimethylphenyl)cyclohexane, bis-(4-hydroxyphenyl)phenylmethane, 1,1-bis-(4-hydroxyphenyl)-1-phenylethane, 1,1-bis-(4-hydroxyphenyl)-1-phenylpropane, bis-(4-hydroxyphenyl)diphenylmethane, bis-(4-hydroxyphenyl)dibenzylmethane, 4,4'-[1,4-phenylenebis(1-methylethylidene)]bis-[phenol], 4,4'-[1,4-phenylenebismethylene]bis-[phenol], 4,4'-[1,4-phenylenebis(1-methylethylidene)]bis-[2,6-dimethylphenol], 4,4'-[1,4-phenylenebismethylene]bis-[2,6-dimethylphenol], 4,4'-[1,4-phenylenebismethylene]bis-[2,3,6-trimethylphenol], 4,4'-[1,4-phenylenebis(1-methylethylidene)]bis-[2,3,6-trimethylphenol], 4,4'-[1,3-phenylenebis(1-methylethylidene)]bis-[2,3,6-trimethylphenol], 4,4'-dihydroxydiphenyl ether, 4,4-bis(4-hydroxyphenyl)valeric acid stearyl ester, 4,4'-dihydroxydiphenylsulfone, 4,4'-dihydroxydiphenylsulfide, 3,3',5,5'-tetramethyl-4,4'-dihydroxydiphenyl ether, 3,3',5,5'-tetramethyl-4,4'-dihydroxydiphenylsulfone, 3,3',5,5'-tetramethyl-4,4'-dihydroxydiphenylsulfide, phenolphthalein, 4,4'-[1,4-phenylenebis(1-methylvinylidene)]bisphenol, 4,4'-[1,4-phenylenebis(1-methylvinylidene)]bis[2-methylphenol], (2-hydroxyphenyl)(4-hydroxyphenyl)methane, (2-hydroxy-5-methylphenyl)(4-hydroxy-3-methylphenyl)methane, 1,1-(2-hydroxyphenyl)(4-hydroxyphenyl)ethane, 2,2-(2-hydroxyphenyl)(4-hydroxyphenyl)propane or 1,1-(2-hydroxyphenyl)(4-hydroxyphenyl)propane; or a biphenol component such as 4,4'-biphenol, 2,4'-biphenol, 3,3'-dimethyl-4,4'-dihydroxy-1,1'-biphenyl, 3,3'-dimethyl-2,4'-dihydroxy-1,1'-biphenyl, 3,3'-di-(t-butyl)-4,4'-dihydroxy-1,1'-biphenyl, 3,3',5,5'-tetramethyl-4,4'-dihydroxy-1,1'-biphenyl, 3,3',5,5'-tetra(t-butyl)-4,4'-dihydroxy-1,1'-biphenyl or 2,2',3,3',5,5'-hexamethyl 4,4'-dihydroxy-1,1'-biphenyl.

Among them, a preferred compound may be a bisphenol component such as bis(4-hydroxy-3,5-dimethylphenyl)methane, bis(4-hydroxyphenyl)methane, bis(4-hydroxy-3-methylphenyl)methane, 2,2-bis(4-hydroxy-3-methylphenyl)propane, 1,1-bis(4-hydroxyphenyl)ethane, 2,2-bis(4-hydroxyphenyl)propane, 2-hydroxyphenyl(4-hydroxyphenyl)methane or 2,2-(2-hydroxyphenyl)(4-hydroxyphenyl)propane.

Now, the diol component (such as a bisphenol or a biphenol) of the polycarbonate resin which may be suitably used, will be specifically exemplified below. However, it should be understood that such exemplification is to make the purpose of the present invention clear, and the present invention is by no means restricted to such exemplified structure.

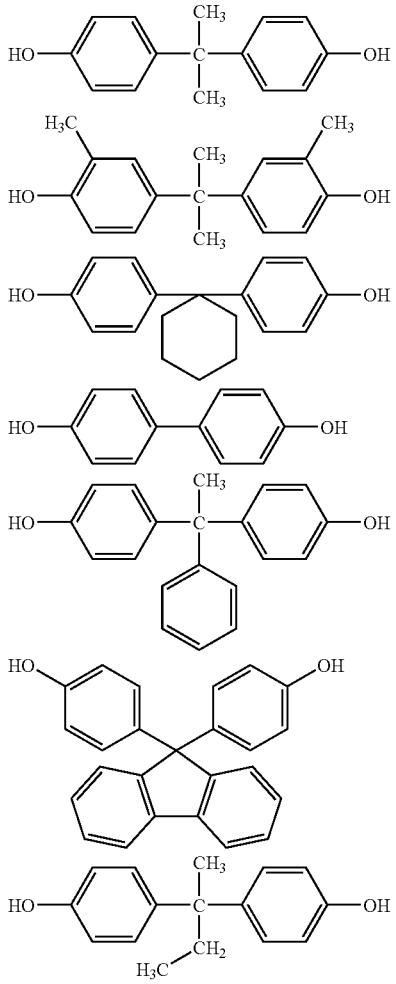

Especially, in order to maximize the effects of the present invention, diol components having the following structures, are preferred.

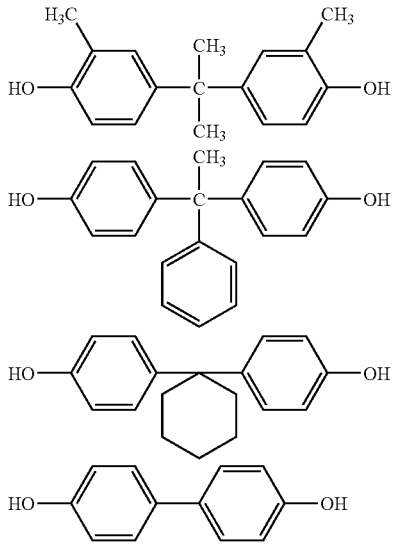

Further, as the acid component, it is preferred to employ those having the following structures.

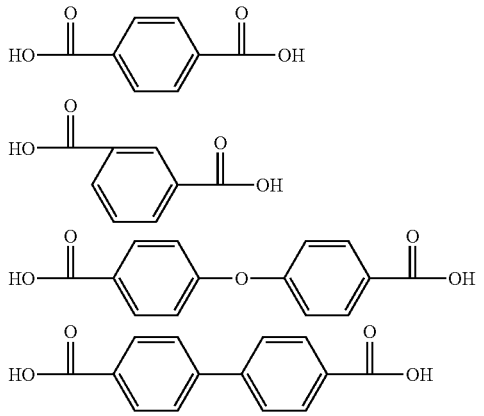

A particularly preferred acid component is one having the following structure.

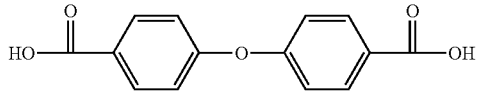

These dicarboxylic acid components or diol components may be used in combination as a mixture of a plurality of them.

If the molecular weight of the binder resin is too low, the mechanical strength will be inadequate. On the other hand, if the molecular weight is too high, there may be a trouble such that the viscosity of the coating liquid for forming a photosensitive layer is too high, and the productivity will deteriorate. Therefore, in the case of the polycarbonate resin or the polyester resin (including a polyarylate resin), the viscosity average molecular weight is preferably at least 10,000, particularly preferably at least 20,000. Further, it is preferably at most 70,000, particularly preferably at most 50,000. The viscosity average molecular weight is measured by the measuring method disclosed in Examples and is thereby defined.

It is also preferred that the photosensitive layer which the electrophotographic photoreceptor of the present invention has, contains a polyarylate resin. It is particularly preferred that the charge transport layer contains a polyarylate resin. The polyarylate resin functions as a binding resin.

The polyarylate resin is one type of polyesters, and is formed by condensation of a bivalent alcohol having a ring with aromaticity and a bivalent carboxylic acid having a ring with aromaticity.

In the electrophotographic photoreceptor of the present invention, it is preferred to use a polyarylate resin in order to improve e.g. mechanical characteristics in combination with the charge transport material represented by the formula (1).

Now, the polyarylate resin to be used in the present invention will be described in detail.

The bivalent alcohol having a ring with aromaticity may be any one usually used for production of a polyarylate resin, and preferably a bisphenol and/or a biphenol is used. Each of the bisphenol and the biphenol may independently have a substituent on its aromatic ring. More specifically, it may preferably have an alkyl group, an aryl group, a halogen atom or an alkoxy group.

Considering mechanical characteristics as the binder resin for a photosensitive layer and the solubility in a solvent in preparation of a coating liquid for formation of the photosensitive layer, the alkyl group is preferably an alkyl group having at most 6 carbon atoms, more preferably a methyl group, an ethyl group or a propyl group. The aryl group is preferably an aryl group having at most 3 aromatic rings, more preferably a phenyl group or a naphthyl group. The halogen atom is preferably a fluorine atom, a chlorine atom, a bromine atom, an iodine atom or the like. The alkoxy group is preferably an alkoxy group in which the alkyl group moiety has from 1 to 10 carbon atoms, more preferably from 1 to 8 carbon atoms, particularly preferably from 1 to 2 carbon atoms. Specifically, a methoxy group, an ethoxy group, a butoxy group or the like is particularly preferred.

As the bivalent alcohol to be used for the polyarylate resin, one used for the above-mentioned carbonate resins or polyester resins, may be mentioned. The bivalent alcohol which may be used particularly suitably for the polyarylate, may specifically be bis(4-hydroxyphenyl)methane, (2-hydroxyphenyl) (4-hydroxyphenyl)methane, bis(2-hydroxyphenyl) methane, bis(4-hydroxy-3-methylphenyl)methane, bis(4-hydroxy-3-ethylphenyl)methane, bis(4-hydroxy-3,5-dimethylphenyl)methane; 1,1-bis(4-hydroxyphenyl)ethane, 1-(2-hydroxyphenyl)-1-(4-hydroxyphenyl)ethane, 1,1-bis(2-hydroxyphenyl)ethane, 1,1-bis(4-hydroxy-3-methylphenyl) ethane, 1,1-bis(4-hydroxy-3-ethylphenyl)ethane, 1,1-bis(4-hydroxy-3,5-dimethylphenyl)ethane, 1,1-bis(4-hydroxy-3-methylphenyl)ethane, 1,1-bis(4-hydroxy-3,5-dimethylphenyl)ethane; 3,3',5,5'-tetramethyl-4,4'-dihydroxybiphenyl, 2,2-bis(4-hydroxy-3,5-dimethylphenyl) propane, 2,2-bis(4-hydroxy-3-methylphenyl)propane, 2,2-bis(4-hydroxyphenyl)propane, 2,2-bis(4-hydroxy-3,5-dimethylphenyl)propane; 1,1-bis(4-hydroxy-3,5-dimethylphenyl)cyclohexane, 1,1-bis(4-hydroxy-3-methylphenyl)cyclohexane, 1,1-bis(4-hydroxyphenyl) cyclohexane; bis(4-hydroxyphenyl)ketone; bis(4-hydroxyphenyl)ether, bis(4-hydroxy-3,5-dimethylphenyl) ether, (2-hydroxyphenyl)(4-hydroxyphenyl)ether, bis(2-hydroxyphenyl)ether, bis(4-hydroxy-3-methylphenyl)ether or bis(4-hydroxy-3-ethylphenyl)ether. Such bivalent alcohol components may be used in combination.

Among them, particularly preferred is a polyarylate having a bivalent alcohol of the following structure as a repeating unit structure.

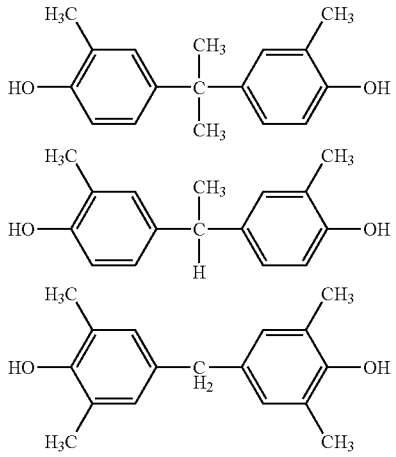

-continued

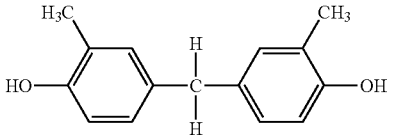

The bivalent carboxylic acid having a ring with aromaticity may be any one usually used for production of a polyarylate resin. More specifically, it may be phthalic acid, isophthalic acid, naphthalene-1,4-dicarboxylic acid, naphthalene-2,6-dicarboxylic acid, biphenyl-2,2'-dicarboxylic acid, biphenyl-4,4'-dicarboxylic acid, diphenyl ether-2,2'-dicarboxylic acid, diphenyl ether-2,3'-dicarboxylic acid, diphenyl ether-2,4'-dicarboxylic acid, diphenyl ether-3,3'-dicarboxylic acid, diphenyl ether-3,4'-dicarboxylic acid or diphenyl ether-4,4'-dicarboxylic acid. It is preferably isophthalic acid, terephthalic acid, diphenyl ether-2,2'-dicarboxylic acid, diphenyl ether-2,4'-dicarboxylic acid or diphenyl ether-4,4'-dicarboxylic acid, particularly preferably isophthalic acid, terephthalic acid, diphenyl ether-4,4'-dicarboxylic acid or biphenyl-4,4'-dicarboxylic acid. Such dicarboxylic acids may be used in combination.

A method for producing the polyarylate resin is not particularly limited, and a known polymerization method such as an interfacial polymerization method, a molten polymerization method or a solution polymerization method may be employed.

For example, in the case of production by an interfacial polymerization method, a solution having a bivalent phenol component dissolved in an aqueous alkaline solution and a solution of a halogenated hydrocarbon having an aromatic dicarboxylic chloride component dissolved therein, are mixed. At that time, as a catalyst, a quaternary ammonium salt or a quaternary phosphonium salt may be present. The polymerization temperature is preferably within a range of from 0 to 40° C., and the polymerization time is preferably within a range of from 2 to 20 hours, in view of productivity. After completion of the polymerization, an aqueous phase and an organic phase are separated, and a polymer dissolved in the organic phase is washed and recovered by a known method to obtain an aimed polyarylate resin.

The alkali component used in the interfacial polymerization method may, for example, be a hydroxide of an alkali metal such as sodium hydroxide or potassium hydroxide. The amount of the alkali is preferably within a range of from 1.01 to 3 equivalent amount of the phenolic hydroxyl groups contained in the reaction system.

The halogenated hydrocarbon to be used as a solvent may, for example, be dichloromethane, chloroform, 1,2-dichloroethane, trichloroethane, tetrachloroethane or dichlorobenzene.

The quaternary ammonium salt or the quaternary phosphonium salt used as the catalyst may, for example, be a salt such as hydrochloride, bromate or iodate of a tertiary alkyl amine such as tributylamine or trioctylamine; or benzyltriethylammonium chloride, benzyltrimethylammonium chloride, benzyltributylammonium chloride, tetraethylammonium chloride, tetrabutylammonium chloride, tetrabutylammonium bromide, trioctylmethylammonium chloride, tetrabutyl phosphonium bromide, triethyloctadecyl phosphonium bromide, N-laurylpyridinium chloride or laurylpicolinium chloride.

Further, in the interfacial polymerization method, a molecular weight modifier may be used. The molecular weight modifier may, for example, be phenol; an alkyl phenol such as o,m,p-cresol, o,m,p-ethylphenol, o,m,p-propylphenol, o,m,p-(tert-butyl)phenol, pentylphenol, hexylphenol, octylphenol, nonylphenol, a 2,6-dimethylphenol derivative or a 2-methylphenol derivative; or a monofunctional phenol such as o,m,p-phenylphenol. Further, a monofunctional acid halide such as acetyl chloride, butyryl chloride, octyl chloride, benzoyl chloride, benzenesulfonyl chloride, benzenesulfinyl chloride, sulfinyl chloride or benzene phosphonyl chloride, or a substituted product thereof, may be mentioned.

Among such molecular weight modifiers, preferred is o,m,p-(tert-butyl)phenol, a 2,6-dimethylphenol derivative or a 2-methylphenol derivative in view of high molecular weight modifying property and stability of the solution. Particularly preferred is p-(tert-butyl)phenol, 2,3,6-tetramethylphenol or 2,3,5-tetramethylphenol.

The viscosity average molecular weight of the polyarylate resin is not particularly limited, and it is usually at least 10,000, preferably at least 15,000, more preferably at least 20,000, and it is usually at most 300,000, preferably at most 200,000, more preferably at most 100,000, particularly preferably at most 70,000. If the viscosity average molecular weight is excessively low, mechanical strength of the photosensitive layer tends to decrease, such being impractical. Further, if the viscosity average molecular weight is excessively high, it will be difficult to form the photosensitive layer in a proper thickness by coating. The viscosity average molecular weight is measured by the measuring method disclosed in Examples and is thereby defined.

In a case where the photosensitive layer which the electrophotographic photoreceptor of the present invention has, contains a polyarylate resin, the mass ratio of the charge transport material represented by the is formula (1) to the binder resin is not limited, but is preferably in the range mentioned above in the general description of the binder resin. Particularly, in a case where the binder resin contains a polyarylate resin, the ratio to the mass content of all binder resins including the polyarylate resin, of the total mass of the charge transport material represented by the formula (1) contained in the charge transport layer i.e. parts by mass of the charge transport material represented by the formula (1) in the charge transport layer (i.e. the total parts by mass in a case where a plurality of charge transport materials represented by the formula (1) are contained) is preferably at least 20 parts by mass with a view to lowering the residual potential of the electrophotographic photoreceptor, more preferably at least 25 parts by mass from the viewpoint of the stability in repeated use and charge mobility, when the content of the entire binder resin is 100 parts by mass. On the other hand, from the viewpoint of thermal stability of the photosensitive layer, it is at most 90 parts by mass, preferably at most 80 parts by mass from the viewpoint of the stability of the compound of the formula (1) in the photosensitive layer, more preferably at most 65 parts by mass, further preferably at most 60 parts by mass, from the viewpoint of the durability at the time of forming an image, particularly preferably at most 40 parts by mass from the viewpoint of scratch resistance.

Here, "the mass content of all binder resins" means, in a case where binder resins other than the polyarylate resins are contained, the mass content of all of binder resins including them.

Further, in a case where "other charge transport materials" other than the charge transport material represented by the formula (1) are also contained in the charge transport layer, and a plurality of charge transport materials including them, are contained, the content of the total charge transport materials contained in the charge transport layer is at least 25 parts by mass per 100 parts by mass of the content of all binder resins including the polyarylate resin, preferably at least 30 parts by mass with a view to lowering the residual potential, more preferably at least 40 parts by mass from the viewpoint of the stability in repeated use and charge mobility. On the other hand, from the viewpoint of the thermal stability of the photosensitive layer, it is usually at most 55 parts by mass, preferably at most 50 parts by mass from the viewpoint of compatibility between the charge transport material and the binder resin, further preferably at most 35 parts by mass from the viewpoint of printability, most preferably at most 45 parts by mass from the viewpoint of scratch resistance. Here, the above "total charge transport materials" means both the charge transport material represented by the formula (1) and "other charge transport materials".

(Antioxidant)

The electrophotographic photoreceptor of the present invention preferably contains an antioxidant. The antioxidant is a type of a stabilizer to be incorporated to prevent oxidation of a component contained in the electrophotographic photoreceptor. Usually, oxidation of a component contained in the electrophotographic photoreceptor starts from the surface, and accordingly, the antioxidant is preferably incorporated in the outermost surface layer of the electrophotographic photoreceptor.

The antioxidant has a function as a radical scavenger, and specifically, a phenol derivative, an amine compound, a phosphonate, a sulfur compound, a vitamin or a vitamin derivative, may, for example, be mentioned. Among them, a phenol derivative, an amine compound, a vitamin or the like is preferred. More preferred is a hindered phenol having a bulky substituent near the hydroxyl group or a trialkylamine derivative. Further, an aryl compound derivative having a t-butyl group at the o-position to the hydroxyl group, is preferred, and an aryl compound derivative having two t-butyl groups at the o-position to the hydroxyl group, is further preferred.

If the molecular weight of the antioxidant measured by gel permeation chromatography is too large, there may be a problem with respect to the oxidation preventing ability. Therefore, it is preferably at most 1,500, particularly preferably at most 1,000. The lower limit is preferably at least 100, more preferably at least 150, particularly preferably at least 200.

Now, the antioxidant which may be used in the present invention will be shown. As the antioxidant which may be used in the present invention, all of known materials such as an antioxidant, a ultraviolet absorber, a photostabilizer, etc. which are used for plastics, rubbers, petroleum and fats and fatty oils, may be used. Especially, a material selected from the following group of compounds may be preferably used.

(1) Phenols disclosed in JP-A-57-122444, phenol derivatives disclosed in JP-A-60-188956 and hindered phenols disclosed in JP-A-63-18356.

(2) Paraphenylenediamines disclosed in JP-A-57-122444, paraphenylenediamine derivatives disclosed in JP-A-60-188956 and paraphenylenediamines disclosed in JP-A-63-18356.

(3) Hydroquinones disclosed in JP-A-57-122444, hydroquinone derivatives disclosed in JP-A-60-188956 and hydroquinones disclosed in JP-A-63-18356.

(4) Sulfur compounds disclosed in JP-A-57-188956 and organic sulfur compounds disclosed in JP-A-63-18356.

(5) Organic phosphorus compounds disclosed in JP-A-57-122444 and organic phosphorus compounds disclosed in JP-A-63-18356.

(6) Hydroxyanisoles disclosed in JP-A-57-122444.

(7) Piperidine derivatives and oxopiperazine derivatives having a specific skeleton structure disclosed in JP-A-63-18355.

(8) Carotenes, amines, tocopherols, Ni(II) complexes, sulfides and the like disclosed in JP-A-60-188956.

Further, particularly preferred are the following hindered phenols (hindered phenols are meant for phenols having a bulky substituent near the hydroxyl group). Octadecyl-3,5-di-t-butyl-4-hydroxyhydrocinnamate, dibutylhydroxytoluene, 2,2'-methylenebis(6-t-butyl-4-methylphenol), 4,4'-butylidenebis(6-t-butyl-3-methylphenol), 4,4'-thiobis(6-t-butyl-3-methylphenol), 2,2'-butylidenebis(6-t-butyl-4-methylphenol), α-tocopherol, β-tocopherol, 2,2,4-trimethyl-6-hydroxy-7-t-butylchroman, pentaerythritoltetrakis[3-(3,5-di-t-butyl-4-hydroxyphenyl)propionate], 2,2'-thiodiethylenebis[3-(3,5-di-t-butyl-4-hydroxyphenyl) propionate], 1,6-hexanediol bis[3-(3,5-di-t-butyl-4-hydroxyphenyl)propionate], butylhydroxyanisole and dibutylhydroxyanisole. Such compounds are known as antioxidants for rubbers, plastics, fats and fatty oils, etc., and some of them are commercially available.

Further, among the hindered phenols, particularly preferred is octadecyl-3,5-di-t-butyl-4-hydroxyhydrocinnamate. This is commercially available under tradename Irganox1076, and it is also particularly preferred to use the commercial product.

In the electrophotographic photoreceptor of the present invention, the amount of the antioxidant in the outermost surface layer is not particularly limited, and it is preferably at least 0.1 part by mass and at most 20 parts by mass per 100 parts by weight of the binder resin. No favorable electric characteristics may be obtained in some cases if the amount is out of this range. It is particularly preferably at least 1 part by mass. Further, if the amount is too large, not only the electric characteristics but also printing durability may be impaired in some cases, and accordingly it is preferably at most 15 parts by mass, more preferably at most 10 parts by mass.

To the photosensitive layer, known additives such as a plasticizer, an ultraviolet absorber, an electron-withdrawing compound and a leveling agent may be incorporated for improving the film-forming properties, flexibility, coating property, stain resistance, gas resistance, lightfastness, and the like.

(Other Layers)

On the photosensitive layer, an overcoat layer may be provided for the purpose of preventing the wear of the photosensitive layer, or preventing or reducing the deterioration of the photosensitive layer due to the discharge product or the like arising form a charger or the like. Further, the overcoat layer may contain a fluororesin, a silicone resin or the like for the purpose of reducing the frictional resistance or the abrasion on the surface of the photoreceptor. Further, it may also contain particles made of such a resin or particles of an inorganic compound.

(Method for Forming Layers)

The respective layers constituting the photoreceptor are formed by sequentially applying coating liquids obtained by dissolving or dispersing the respective materials to be contained in a solvent, to the substrate by a known method such as dip coating, spray coating, nozzle coating, bar coating, roll coating or blade coating.

The solvent or dispersion medium to be used for preparation of the coating liquid may, for example, be an alcohol such as methanol, ethanol, propanol or 2-methoxyethanol; an ether such as tetrahydrofuran, 1,4-dioxane or dimethoxyethane; an ester such as methyl formate or ethyl acetate; a ketone such as acetone, methyl ethyl ketone, cyclohexanone or 4-methoxy-4-methyl-2-pentanone; an aromatic hydrocarbon such as benzene, toluene or xylene; a chlorinated hydrocarbon such as dichloromethane, chloroform, 1,2-dichloroethane, 1,1,2-trichloroethane, 1,1,1-trichloroethane, tetrachloroethane, 1,2-dichloropropane or trichloroethylene; a nitrogen-containing compound such as n-butylamine, isopropanolamine, diethylamine, triethanolamine, ethylenediamine or triethylenediamine; or an aprotic polar solvent such as acetonitrile, N-methylpyrrolidone, N,N-dimethylformamide or dimethyl sulfoxide. They may be used alone or in combination of two or more of them.

In preparation of the coating liquid or the dispersion liquid, in the case of the charge generation layer in the lamination type photosensitive layer, the solid content concentration is preferably at most 15 wt %, more preferably from 1 to 10 wt %, and the viscosity is preferably from 0.1 to 10 cps.

(Image Forming Apparatus)

Now, the embodiment of an image forming apparatus (image forming apparatus of the present invention) employing the electrophotographic photoreceptor of the present invention will be described with reference to FIG. 1 illustrating a structure of a substantial part of the apparatus. However, the embodiment is not limited to the following description, and various changes and modifications may be made without departing from the spirit and scope of the present invention.

As shown in FIG. 1, the image forming apparatus comprises an electrophotographic photoreceptor 1, a charging apparatus 2, an exposure apparatus 3 and a developing apparatus 4, and it further has a transfer apparatus 5, a cleaning apparatus 6 and a fixing apparatus 7 as the case requires.

The electrophotographic photoreceptor 1 is not particularly limited so long as it is the above-described electrophotographic photoreceptor of the present invention, and in FIG. 1, as one example thereof, a drum form photoreceptor comprising a cylindrical electroconductive substrate and the above-described photosensitive layer formed on the surface of the substrate is shown. Along the outer peripheral surface of the electrophotographic photoreceptor 1, the charging apparatus 2, the exposure apparatus 3, the developing apparatus 4, the transfer apparatus 5 and the cleaning apparatus 6 are disposed.

The charging apparatus 2 is to charge the electrophotographic photoreceptor 1, and uniformly charges the surface of the electrophotographic photoreceptor 1 to a predetermined potential. As the charging apparatus, a corona charging apparatus such as corotron or scorotron, a direct charging apparatus (contact charging apparatus) to charge by contacting a charged component directly to the surface of the photoreceptor, or a contact charging apparatus such as a charging brush, or the like may, for example, be used. As an example of the direct charging means, a contact charger such as a charging roller or a charging brush may be mentioned. In FIG. 1, as an example of the charging apparatus 2, the roller type charging apparatus (charging roller) is shown.

The direct charging means may be charging accompanying aerial discharge or injection charging not accompanying aerial discharge. Further, the voltage to be applied for charging may be DC voltage alone or DC may be used as superimposed on AC.

Among them, a direct charging apparatus (contact charging apparatus) to charge by contacting a charged component directly to the surface of the electrophotographic photoreceptor, is preferred. Namely, an electrophotographic photoreceptor is charged by a charger disposed in contact with the electrophotographic photoreceptor to form an image, such being preferred with a view to reducing a load which will be a cause for various deterioration given to the electrophotographic photoreceptor.

The type of the exposure apparatus 3 is not particularly limited so long as the electrophotographic photoreceptor 1 is exposed to form an electrostatic latent image on the photosensitive surface of the electrophotographic photoreceptor 1. Specific examples thereof include a halogen lamp, a fluorescent lamp, a laser such as a semiconductor laser or a He—Ne laser and LED. Further, exposure may be carried out by a photoreceptor internal exposure method.

The light for the exposure is optional. For example, exposure may preferably be carried out with a monochromatic light having a wavelength of 780 nm, a monochromatic light slightly leaning to short wavelength side having a wavelength of from 600 nm to 700 nm, a monochromatic light having a wavelength of from 380 nm to 500 nm or the like.

It is particularly preferred to form an image by exposure with a monochromatic light having a wavelength of from 380 nm to 500 nm, whereby it is possible to form an image having a high resolution free from image defect.

The type of the developing apparatus 4 is not particularly limited, and an optional apparatus of e.g. a dry development method such as cascade development, single component conductive toner development or two component magnetic brush development or a wet development method may be used. In FIG. 1, the developing apparatus 4 comprises a developing tank 41, an agitator 42, a supply roller 43, a developing roller 44 and a control member 45, and a toner T is stored in the developing tank 41. Further, as the case requires, the developing apparatus 4 may have a supply apparatus (not shown) which supplies the toner T. The supply apparatus is constituted so that the toner T can be supplied from a container such as a bottle or a cartridge.

The supply roller 43 is formed from e.g. an electrically conductive sponge.

The developing roller 44 is a metal roll of e.g. iron, stainless steel, aluminum or nickel, or a resin roll having such a metal roll covered with a silicone resin, a urethane resin, a fluororesin or the like. A smoothing treatment or a roughening treatment may be applied to the surface of the developing roller 44 as the case requires.

The developing roller 44 is disposed between the electrophotographic photoreceptor 1 and the supply roller 43, and is in contact with each of the electrophotographic photoreceptor 1 and the supply roller 43. The supply roller 43 and the developing roller 44 are rotated by a rotation driving mechanism (not shown). The supply roller 43 supports the stored toner T and supplies it to the developing roller 44. The developing roller 44 supports the toner T supplied by the supply roller 43 and brings it into contact with the surface of the electrophotographic photoreceptor 1.

The control member 45 is formed by a resin blade of e.g. a silicone resin or a urethane resin, a metal blade of e.g. stainless steel, aluminum, copper, brass or phosphor bronze, or a blade having such a metal blade covered with a resin. The control member 45 is in contact with the developing roller 44, and is pressed under a predetermined force to the side of the developing roller 44 by e.g. a spring (usual blade linear pressure is from 5 to 500 g/cm$^2$). As the case requires, the control member 45 may have a function to charge the toner T by means of frictional electrification with the toner T.

The agitator 42 is rotated by a rotation driving mechanism, and stirs the toner T and transports the toner T to the supply roller 43. A plurality of agitators 42 with different blade shapes or sizes may be provided.

The type of the transfer apparatus 5 is not particularly limited, and an apparatus of optional method such as an electrostatic transfer method such as corona transfer, roller transfer or belt transfer, a pressure transfer method or an adhesive transfer method may be used. In this case, the transfer apparatus 5 comprises a transfer charger, a transfer roller, a transfer belt and the like which are disposed to face the electrophotographic photoreceptor 1. The transfer apparatus 5 applies a predetermined voltage (transfer voltage) at a polarity opposite to the charge potential of the toner T and transfers a toner image formed on the electrophotographic photoreceptor 1 to a recording paper (paper sheet, medium) P.

The cleaning apparatus 6 is not particularly limited, and an optional cleaning apparatus such as a brush cleaner, a magnetic brush cleaner, an electrostatic brush cleaner, a magnetic roller cleaner or a blade cleaner may be used. The cleaning apparatus 6 is to scrape away the remaining toner attached to the photoreceptor 1 by a cleaning member and to recover the remaining toner. If there is no or little toner remaining on the photoreceptor, the cleaning apparatus 6 is not necessarily provided.

The fixing apparatus 7 comprises an upper fixing member (fixing roller) 71 and a lower fixing member (fixing roller) 72, and a heating apparatus 73 is provided in the interior of the fixing member 71 or 72. FIG. 1 illustrates an example wherein the heating apparatus 73 is provided in the interior of the upper fixing member 71. As each of the upper and lower fixing members 71 and 72, a known heat fixing member such as a fixing roll comprising a metal cylinder of e.g. stainless steel or aluminum covered with a silicon rubber, a fixing roll further covered with a fluororesin or a fixing sheet may be used. Further, each of the fixing members 71 and 72 may have a structure to supply a release agent such as a silicone oil so as to improve the releasability, or may have a structure to forcibly apply a pressure to each other by e.g. a spring.

The toner transferred on the recording paper P is heated to a molten state when it passes through the upper fixing member 71 and the lower fixing member 72 heated to a predetermined temperature, and then cooled after passage and fixed on the recording paper P.

The type of the fixing apparatus is also not particularly limited, and one used in this case, or a fixing apparatus by an optional method such as heated roller fixing, flash fixing, oven fixing or pressure fixing may be provided.

In the electrophotographic apparatus constituted as mentioned above, recording of an image is carried out as follows. Namely, the surface (photosensitive surface) of the photoreceptor 1 is charged to a predetermined potential (−600 V for example) by the charging apparatus 2. In this case, it may be charged by a direct voltage or may be charged by superposing an alternating voltage to a direct voltage.

Then, the charged photosensitive surface of the photoreceptor 1 is exposed by means of the exposure apparatus 3 in accordance with the image to be recorded to form an electrostatic latent image on the photosensitive surface. Then, the electrostatic latent image formed on the photosensitive surface of the photoreceptor 1 is developed by the developing apparatus 4.

The developing apparatus 4 forms the toner T supplied by the supply roller 43 into a thin layer by the control member (developing blade) 45 and at the same time, charges the toner T to a predetermined polarity (in this case, the same polarity as the charge potential of the photoreceptor 1 and negative polarity) by means of frictional electrification, transfers it while supporting it by the developing roller 44 and brings it into contact with the surface of the photoreceptor 1.

When the charged toner T supported by the developing roller 44 is brought into contact with the surface of the photoreceptor 1, a toner image corresponding to the electrostatic latent image is formed on the photosensitive surface of the photoreceptor 1. Then, the toner image is transferred to the recording paper P by the transfer apparatus 5. Then, the toner remaining on the photosensitive surface of the photoreceptor 1 without being transferred is removed by the cleaning apparatus 6.

After the toner image is transferred to the recording paper P, the recording paper P is made to pass through the fixing apparatus 7 so that the toner image is heat fixed on the recording paper P, whereby an image is finally obtained.

The image forming apparatus may have a structure capable of carrying out a charge removal step in addition to the above-described structure. The charge removal step is a step of carrying out charge removal of the electrophotographic photoreceptor by exposing the electrophotographic photoreceptor, and as a charge removal apparatus, a fluorescent lamp or LED may, for example, be used. Further, the light used in the charge removal step, in terms of intensity, is a light having an exposure energy at least three times the exposure light in many cases.

Further, the image forming apparatus may have a further modified structure, and it may have, for example, a structure capable of carrying out a step such as a pre-exposure step or a supplementary charging step, a structure of carrying out offset printing or a full color tandem structure employing plural types of toners.

Further, the electrophotographic photoreceptor 1 may be combined with one or more among the charging apparatus 2, the exposure apparatus 3, the developing apparatus 4, the transfer apparatus 5, the cleaning apparatus 6 and the fixing apparatus 7 to constitute a unitary cartridge (hereinafter optionally referred to as "an electrophotographic photoreceptor cartridge"), and such an electrophotographic photoreceptor cartridge may be detachably mounted on the main body of an electrophotographic apparatus such as a copying machine or a laser beam printer. In such a case, for example, when the electrophotographic photoreceptor 1 or other components underwent deterioration, the electrophotographic photoreceptor cartridge may be detached from the main body of the image-forming apparatus, and another fresh electrophotographic photoreceptor cartridge may be mounted on the main body of the image-forming apparatus, whereby the maintenance of the image-forming apparatus will be easy.

EXAMPLES

Now, the present invention will be described in further detail with reference to Examples and Comparative Examples, but it should be understood that the present invention is by no means restricted thereto. In such Examples, "parts" means "parts by mass" unless otherwise specified, and "%" means "mass %" unless otherwise specified.

Preparation of Charge Transport Materials

Preparation Example 1

Preparation of Charge Transport Material (1)

In 300 mL of nitrobenzene, 40 g of p-ditolylamine and 48 g of 4,4'-diiodo-p-terphenyl were heated and stirred at 200° C., and 46 g of copper powder and 100 g of potassium carbonate were added thereto, followed by a reaction at 200° C. for 5 hours in a nitrogen stream. Thereafter, the reaction mixture was cooled to 50° C., and 200 mL of tetrahydrofuran was added thereto, whereupon the solid was collected by filtration. The filtrate was poured into 2,000 mL of methanol, and a precipitate was collected by filtration and purified by silica gel column chromatography to obtain 39 g of a charge transport material (1). The structure was confirmed by mass analysis (m/z): $M^+$=620 (theoretical value: 620) and elemental analysis ($C_{46}H_{40}N_2$): C, 89.10; H, 6.67; N, 4.40 (theoretical values: C, 88.99; H, 6.49; N, 4.51)

Charge transport material (1)

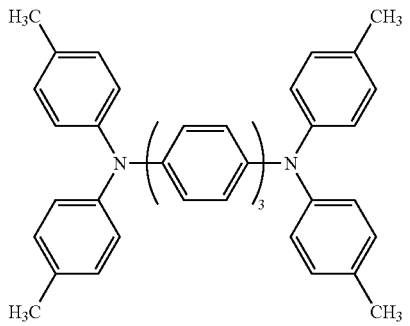

Preparation Example 2

Preparation of Charge Transport Material (2)

In 300 mL of nitrobenzene, 40 g of m,p'-dimethyldiphenylamine and 48 g of 4,4'-diiodo-p-terphenyl were heated and stirred at 200° C., and 46 g of copper powder and 100 g of potassium carbonate were added thereto, followed by a reaction at 200° C. for 5 hours in a nitrogen stream. Thereafter, the reaction mixture was cooled to 50° C., and 200 mL of tetrahydrofuran was added thereto, whereupon the solid was collected by filtration. The filtrate was poured into 2,000 mL of methanol, and a precipitate was collected by filtration and purified by silica gel column chromatography to obtain 40 g of a charge transport material (2). The structure was confirmed by mass analysis (m/z): $M^+$=620 (theoretical value: 620) and elemental analysis ($C_{46}H_{40}N_2$): C, 89.00; H, 6.57; N, 4.50 (theoretical values: C, 88.99; H, 6.49; N, 4.51)

Charge transport material (2)

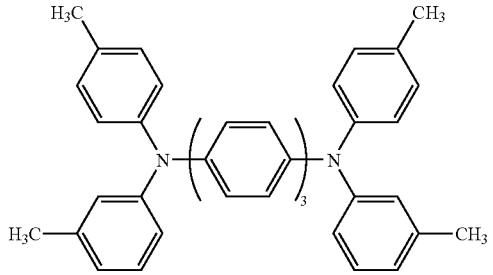

Preparation Example 3

Preparation of Charge Transport Material (3)

Instead of p-ditolylamine used in Preparation Example 1, p-methoxydiphenylamine was used to obtain 42 g of a charge transport material (3). The structure was confirmed by mass analysis (m/z): $M^+$=624 (theoretical value: 624) and elemental analysis ($C_{44}H_{36}N_2O_2$): C, 84.50; H, 5.95; N, 4.50 (theoretical values: C, 84.59; H, 5.81; N, 4.48)

Charge transport material (3)

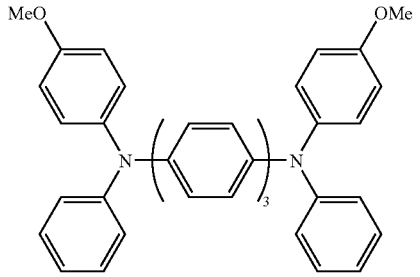

Preparation Example 4

Preparation of Charge Transport Material (4)

Instead of p-ditolylamine used in Preparation Example 1, p-dimethyldiphenylamine was used to obtain 45 g of a charge transport material (4). The structure was confirmed by mass analysis (m/z): $M^+$=592 (theoretical value: 592) and elemental analysis ($C_{44}H_{36}N_2$): C, 89.20; H, 6.20; N, 4.70 (theoretical values: C, 89.15; H, 6.12; N, 4.73)

Charge transport material (4)

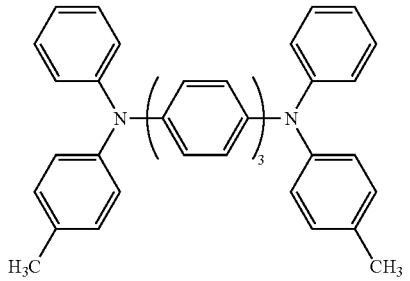

Preparation Example 5

Preparation of Charge Transport Material (5)

20 g of 4-bromo-4'-bis(p-ditolylamino)biphenyl and 5 g of copper powder were introduced into a four-necked flask and stirred at 230° C. for 30 minutes. The obtained mixture was purified by silica gel column chromatography to obtain 2 g of a charge transport material (5). The structure was confirmed by mass analysis (m/z): $M^+$=696 (theoretical value: 696) and elemental analysis ($C_{52}H_{44}N_2$): C, 89.70; H, 6.46; N, 4.01 (theoretical values: C, 89.62; H, 6.36; N, 4.02)

Charge transport material (5)

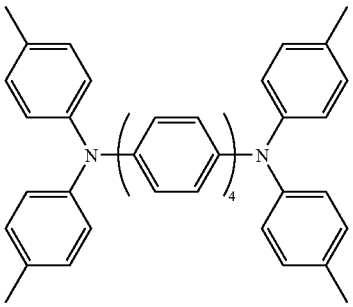

Preparation Example 6

Preparation of Charge Transport Material (6)

In acetonitrile, 20 g of the following fluorine derivative:

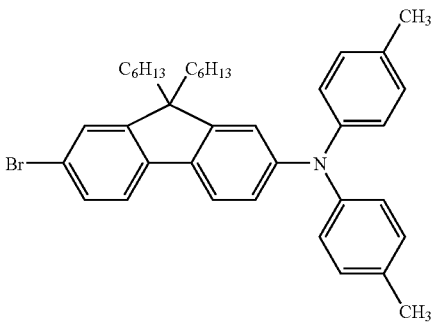

Fluorene derivative the following boron compound:

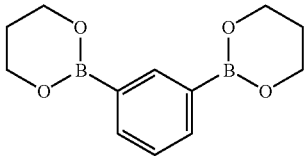

Boron compound potassium hydroxide and palladium tetrakis(triphenylphosphine) were stirred for 48 hours. The obtained mixture was purified by silica gel column chromatography to obtain 6 g of a charge transport material (6). The structure was confirmed by mass analysis (m/z): $M^+$=1133 (theoretical value: 1133) and elemental analysis ($C_{84}H_{96}N_2$): C, 88.70; H, 8.66; N, 2.58 (theoretical values: C, 88.99; H, 8.54; N, 2.47)

Charge transport material (6)

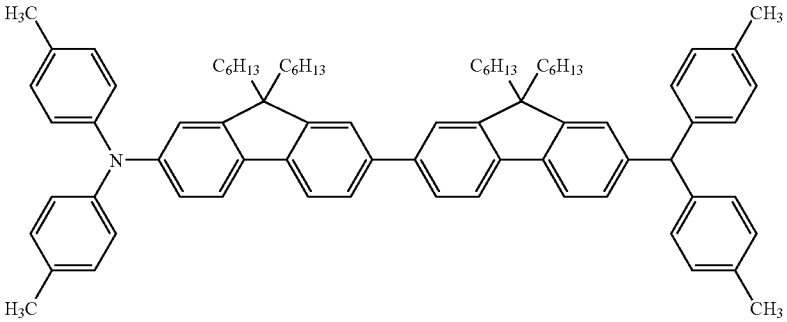

Preparation Example 7

Preparation of CG1

Following "Preparation Example of crude TiOPc" and "Example 1" disclosed in JP-A-10-007925 sequentially, β-form oxytitanium phthalocyanine was prepared. 18 Parts of the obtained oxytitanium phthalocyanine was added to 720 parts of 95% concentrated sulfuric acid cooled to −10° C. or lower. At that time, the addition was carried out slowly so that the internal temperature of the sulfuric acid solution would not exceed −5° C. After completion of the addition, the concentrated sulfuric acid solution was stirred at −5° C. or lower for two hours. After the stirring, the concentrated sulfuric acid solution was filtered through a glass filter to filter off insolubles, whereupon the concentrated sulfuric acid solution was discharged into 10,800 parts of ice water to let the oxytitanium phthalocyanine precipitate, and after the discharge, stirring was continued for one hour. After the stirring, the solution was subjected to filtration, and the obtained wet cake was again washed in 900 parts of water for one hour, followed by filtration. This washing operation was repeated until the ion conductivity of the filtrate became 0.5 mS/m, to obtain 185 parts of a wet cake of low-crystalline oxytitanium phthalocyanine (oxytitanium phthalocyanine content: 9.5%).

93 parts of the obtained wet cake of low-crystalline oxytitanium phthalocyanine was added to 190 parts of water, followed by stirring at room temperature for 30 minutes. Then, 39 parts of o-dichlorobenzene was added, followed by stirring at room temperature for further one hour. After the stirring, water was separated, and 134 parts of MeOH was added, followed by stirring and washing at room temperature for one hour. After the washing, filtration was carried out, and by using 134 parts of MeOH, stirring and washing were carried out again for one hour. Thereafter, filtration was carried out, and heating and drying in a vacuum dryer were carried out to obtain 7.8 parts of oxytitanium phthalocyanine (hereinafter sometimes referred to as "CG1" showing main diffraction peaks at Bragg angles) (2θ±0.2°) of 9.5°, 24.1° and 27.2° to CuKα characteristic X-ray (wavelength: 1.541 Å). The content of chlorooxytitanium phthalocyanine contained in the obtained oxytitanium phthalocyanine was examined by the method (mass spectrum method) disclosed in JP-A-2001-115054, whereby the intensity ratio to oxytitanium phthalocyanine was confirmed to be not more than 0.003.

Preparation Example 8

Preparation of CG2

In the same manner as in Preparation Example 7 except that 50 parts of the wet cake of low-crystalline oxytitanium phthalocyanine obtained in Preparation Example 7 was dispersed in 500 parts of tetrahydrofuran (hereinafter sometimes referred to as THF) and stirred at room temperature for one hour, 3 parts of oxytitanium phthalocyanine (hereinafter sometimes referred to as "CG2") showing main diffraction peaks at Bragg angles (2θ±0.2°) of 9.5°, 24.1° and 27.2° to CuKα characteristic X-ray (wavelength: 1.541 Å) was obtained. The content of chlorooxytitanium phthalocyanine contained in the obtained oxytitanium phthalocyanine was examined by using the method (mass spectrum method) disclosed in JP-A-2001-115054, whereby the intensity ratio to oxytitanium phthalocyanine was confirmed to be not more than 0.003.

Preparation Example 9

Preparation of CG3

In the same manner as in Preparation Example 7 except that β-form oxytitanium phthalocyanine prepared by the method disclosed in "Example 1" of JP-A-2001-115054 was used, 3 parts of oxytitanium phthalocyanine (hereinafter sometimes referred to as "CG3") showing main diffraction peaks at Bragg angles (2θ±0.2°) of 9.5°, 24.1° and 27.2° to CuKα characteristic X-ray (wavelength: 1.541 Å) was obtained. The content of chlorooxytitanium phthalocyanine contained in the obtained oxytitanium phthalocyanine was examined by using the method (mass spectrum method) disclosed in JP-A-2001-115054, whereby the intensity ratio to oxytitanium phthalocyanine was confirmed to be 0.05.

(Measurement of Viscosity Average Molecular Weight of Binder Resin)

Measurement of the viscosity average molecular weight of a binder resin will be described. Namely, a binder resin is dissolved in dichloromethane to prepare a solution having a concentration C of 6.00 g/L. Using a Ubbelohde capillary viscometer with a flow time $t_0$ of the solvent (dichloromethane) being 136.16 seconds, the flow time t (seconds) of the sample solution is measured in a constant temperature water tank set at 20.0° C. The viscosity average molecular weight is calculated by the following formula:

$$a=0.438\times\eta_{sp}+1 \quad \eta_{sp}=(t/t_0)-1$$

$$b=100\times\eta_{sp}/C \quad C=6.00\ (g/L)$$

$$\eta=b/a$$

$$\text{Viscosity average molecular weight}=3207\times\eta^{1.205}$$

Preparation of Electrophotographic Photoreceptors A1 to A16 and P1 to P8

Example 1

10 Parts of the oxytitanium phthalocyanine (CG1) was added to 150 parts of 4-methoxy-4-methyl-2-pentanone, followed by grinding and dispersion treatment by a sand grinding mill.

Further, 100 parts of a 1,2-dimethoxyethane solution containing 5% of polyvinyl butyral (Denka Butyral #6000C, tradename, manufactured by Denki Kagaku Kogyo Kabushiki Kaisha) and 100 parts of a 1,2-dimethoxyethane solution containing 5% of a phenoxy resin (PKHH, tradename, manufactured by Union Carbide) were mixed to prepare a binder resin solution. To 160 parts of the above prepared CG1 dispersion, 100 parts of the above binder solution and a proper amount of 1,2-dimethoxyethane were added to prepare a dispersion having a final solid content concentration of 4.0%.

The obtained dispersion was applied to a polyethylene terephthalate film having a thickness of 75 μm and having aluminum vapor deposited on its surface so that the film thickness would be 0.3 μm after drying, thereby to provide a charge generation layer.

Then, to this film, a liquid having 40 parts of the charge transport material (1), 100 parts of a binder resin (B1) having the following repeating structure (m:n=51:49, viscosity average molecular weight: 30,000):

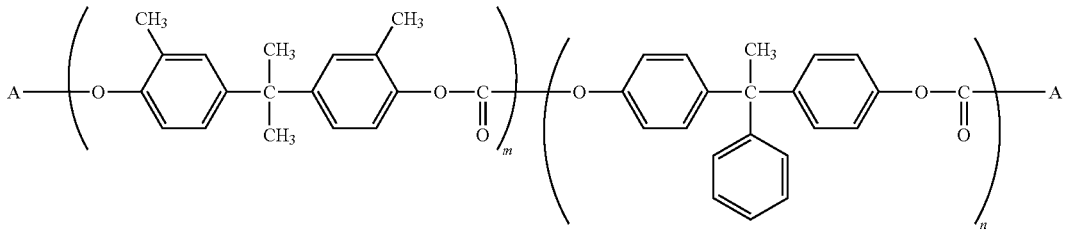

Binder resin (B1)

A: 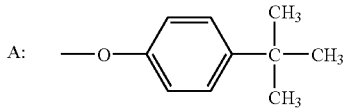

8 parts of an antioxidant (IRGANOX1076, tradename, Ciba Geigy) and 0.03 part of silicone oil as a leveling agent, dissolved in 640 parts of a tetrahydrofuran/toluene mixed solvent=mixing ratio: 8/2, was applied and dried at 125° C. for 20 minutes to provide a charge transport layer so that the film thickness would be 20 μm after drying, thereby to obtain an electrophotographic photoreceptor A1.

Example 2

An electrophotographic photoreceptor A2 was obtained in the same manner as in Example 1 except that instead of the charge transport material (1), the charge transport material (2) was used.

Example 3

An electrophotographic photoreceptor A3 was obtained in the same manner as in Example 1 except that instead of the charge transport material (1), the charge transport material (3) was used.

Example 4

An electrophotographic photoreceptor A4 was obtained in the same manner as in Example 1 except that instead of the charge transport material (1), the charge transport material (4) was used.

Example 5

An electrophotographic photoreceptor A5 was obtained in the same manner as in Example 1 except that instead of 40 parts of the charge transport material (1), 10 parts of the charge transport material (5) and 30 parts of the charge transport material (4) were used.

Example 6

An electrophotographic photoreceptor A6 was obtained in the same manner as in Example 5 except that instead of the charge transport material (5), the charge transport material (6) was used.

Example 7

An electrophotographic photoreceptor A7 was obtained in the same manner as in Example 1 except that instead of the charge transport material (1), 30 parts of the charge transport material (4) was used, and 20 parts of the following compound (A) was used:

Compound (A)

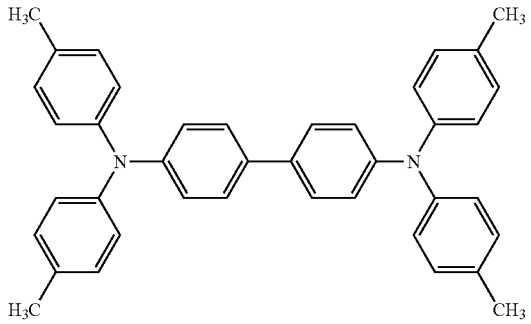

Example 8

An electrophotographic photoreceptor A8 was obtained in the same manner as in Example 1 except that instead of 40 parts of the charge transport material (1), 20 parts of the charge transport material (1) and 10 parts of the charge transport material (4) were used.

Example 9

An electrophotographic photoreceptor A9 was obtained in the same manner as in Example 1 except that instead of 40 parts of the charge transport material (1), 10 parts of the charge transport material (1) was used, and 30 parts of the following compound (B) was used:

Compound (B)

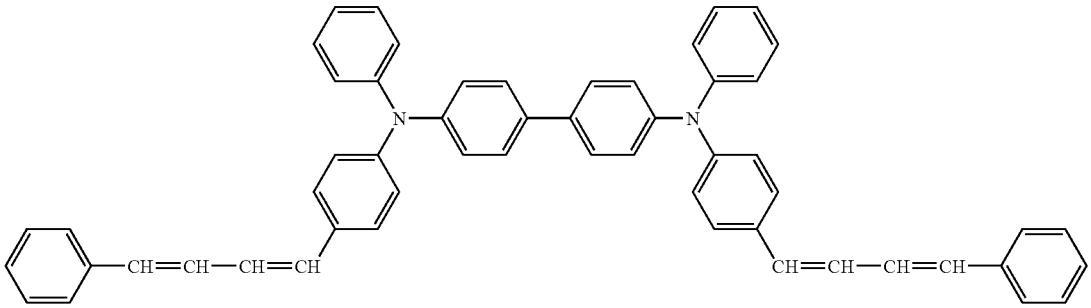

Example 10

An electrophotographic photoreceptor A10 was obtained in the same manner as in Example 4 except that instead of the binder resin (B1) used in Example 4, the following binder resin (B2) (viscosity average molecular weight: 40,000) was used.

Binder resin (B2)

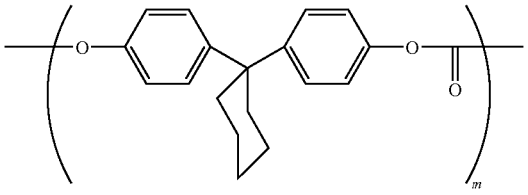

Example 11

An electrophotographic photoreceptor A11 was obtained in the same manner as in Example 4 except that instead of the binder resin (B1) used in Example 4, the following binder resin (B3) (viscosity average molecular weight: 40,000; m:n=9:1) was used.

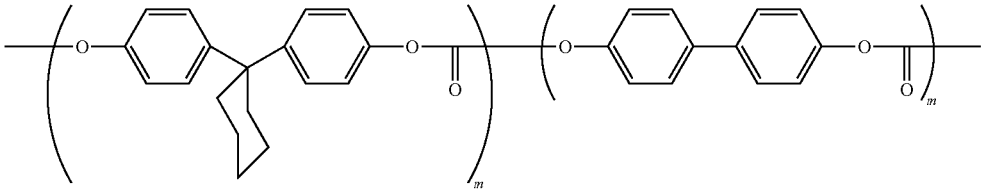

Binder resin (B3)

Example 12

An electrophotographic photoreceptor A12 was obtained in the same manner as in Example 7 except that instead of the compound (A) used in Example 7, the following compound (C) was used, and instead of the binder resin (B1), the binder resin (B3) was used:

Compound (C)

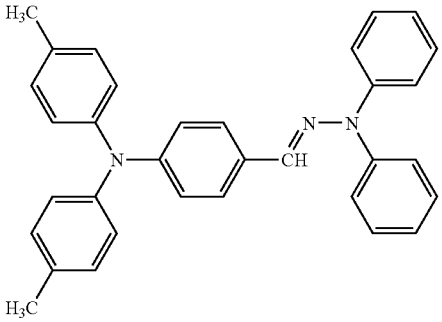

Example 13

An electrophotographic photoreceptor A13 was obtained in the same manner as in Example 1 except that instead of CG1 used in Example 1, CG2 was used.

Example 14

An electrophotographic photoreceptor A14 was obtained in the same manner as in Example 10 except that instead of CG1 used in Example 10, CG2 was used.

Example 14X

An electrophotographic photoreceptor A14X was obtained in the same manner as in Example 10 except that instead of CG1 used in Example 10, CG3 was used, and instead of the charge transport material (4), the charge transport material (1) was used.

Example 15

An electrophotographic photoreceptor A15 was obtained in the same manner as in Example 11 except that instead of CG1 used in Example 11, CG2 was used.

Example 16

An electrophotographic photoreceptor A16 was obtained in the same manner as in Example 7 except that instead of the compound (A) used in Example 7, the following compound (D) was used:

Compound (D)

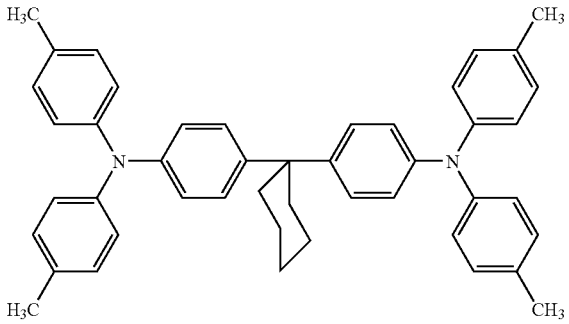

Example 17

An electrophotographic photoreceptor A17 was obtained in the same manner as in Example 1 except that instead of CG1 used in Example 1, oxytitanium phthalocyanine obtained by the method disclosed in "Preparation Examples" in JP-A-8-123052 (hereinafter sometimes referred to as "CG4") was used.

Comparative Example 1

It was attempted to obtain an electrophotographic photoreceptor in the same manner as in Example 1 except that instead of 40 parts of the charge transport material (1), 60 parts of the charge transport material (1) was used, whereby precipitation of solid from the coating liquid was observed.

Comparative Example 2

An electrophotographic photoreceptor P2 was obtained in the same manner as in Example 2 except that instead of 40 parts of the charge transport material (2), 60 parts of the charge transport material (2) was used. After it was left for one week, whitening of the film was observed.

Comparative Example 3

An electrophotographic photoreceptor P3 was obtained in the same manner as in Example 3 except that instead of 40 parts of the charge transport material (3), 60 parts of the charge transport material (3) was used. After it was left for one week, whitening of the film was observed.

Comparative Example 4

An electrophotographic photoreceptor P4 was obtained in the same manner as in Example 3 except that instead of 40 parts of the charge transport material (4), 60 parts of the charge transport material (4) was used. After it was left for one week, precipitation of crystals was observed. Further, gelation of the coating liquid was also observed.

Comparative Example 5

It was attempted to obtain an electrophotographic photoreceptor in the same manner as in Example 5 except that instead of 10 parts of the charge transport material (5), 50 parts of the charge transport material (5) was used, whereby a solid was precipitated from the coating liquid.

Comparative Example 6

It was attempted to obtain an electrophotographic photoreceptor in the same manner as in Comparative Example 5 except that instead of the charge transport material (5), the charge transport material (6) was used, whereby the coating liquid underwent gelation.

Comparative Example 7

An electrophotographic photoreceptor P7 was obtained in the same manner as in Example 9 except that instead of using 10 parts of the charge transport material (1), 2 parts thereof was used.

Comparative Example 8

An electrophotographic photoreceptor P8 was obtained in the same manner as in Example 1 except that instead of the charge transport material (1), the above compound (B) was used.

Comparative Example 9

An electrophotographic photoreceptor P9 was obtained in the same manner as in Example 1 except that instead of the charge transport material (1), the following compound (E) was used:

Compound (E)

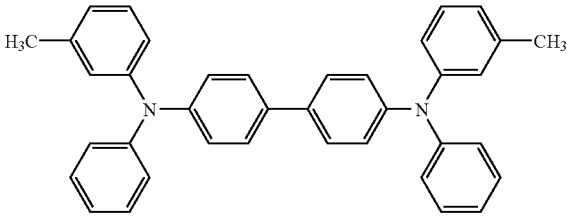

Comparative Example 10

An electrophotographic photoreceptor P10 was obtained in the same manner as in Example 1 except that instead of the charge transport material (1), the following compound (F) was used. Whitening was observed at a part of the coated surface.

Compound (F)

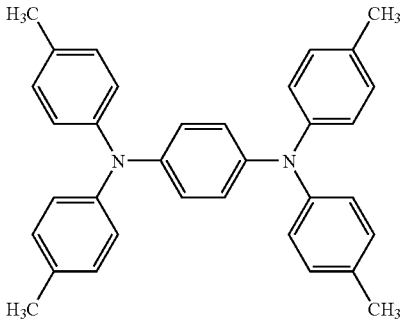

Comparative Example 11

An electrophotographic photoreceptor P11 was obtained in the same manner as in Example 1 except that instead of the charge transport material (1), the compound (D) was used. Whitening was observed at a part of the coated surface.

Comparative Example 12

An electrophotographic photoreceptor P12 was obtained in the same manner as in Example 1 except that instead of the charge transport material (1) used in Example 1, the above-mentioned compound (F), and instead of CG1, oxytitanium phthalocyanine prepared by the method disclosed in "Examples" of JP-A-2001-115054 (hereinafter sometimes referred to as "CG5") was used.

(Evaluation of Electric Characteristics of Electrophotographic Photoreceptor)

By using an electrophotographic characteristic evaluation apparatus (described on pages 404 to 405 in "Electrophotography—Bases and applications, second series" edited by the Society of Electrophotography, Published by Corona Co.), manufactured in accordance with the measurement standard by the Society of Electrophotography, the above electrophotographic photoreceptor was, one week after the preparation, stuck on a drum made of aluminum to be formed in cylinder. Then, the continuity between the drum made of aluminum and the aluminum substrate of the electrophotographic photoreceptor was ensured. Then, the drum was rotated at a constant rpm to perform the electric characteristic evaluation test by cycles of charging, exposure, potential measurement, and charge removal. In this step, the initial surface potential was set at −700 V, a 780-nm monochromatic light was used for the exposure and a 660-nm monochromatic light was used for the charge removal. The surface potential (VL) at the time of irradiation with 1.0 μJ/cm$^2$ of the 780-nm light, and the exposure amount (half decay exposure) required to bring the surface potential to −350 V as an index of the sensitivity, were measured. For measurement of VL, the time required for potential measurement from exposure was set at 100 ms. The measurements were carried out under the environment of a temperature of 25° C. and a relative humidity of 50%. The smaller the sensitivity (half decay exposure) and the absolute value of the VL value, the better the electric characteristics. The results are shown in Table 1.

TABLE 1

| Ex. No. | Photo-recep-tor No. | Charge transport material (parts by mass) | Binder resin | Charge gener-ation material | Half decay exposure (μJ/cm$^2$) | VL (−V) |
|---|---|---|---|---|---|---|
| Ex. 1 | A 1 | 1 (40) | B1 | CG1 | 0.090 | 27 |
| Ex. 2 | A 2 | 2 (40) | B1 | CG1 | 0.089 | 47 |
| Ex. 3 | A 3 | 3 (40) | B1 | CG1 | 0.096 | 54 |
| Ex. 4 | A 4 | 4 (40) | B1 | CG1 | 0.090 | 60 |
| Ex. 5 | A 5 | 5 (10), 4 (30) | B1 | CG1 | 0.094 | 50 |
| Ex. 6 | A 6 | 6 (10), 4 (30) | B1 | CG1 | 0.098 | 53 |
| Ex. 7 | A 7 | 4 (30), A (20) | B1 | CG1 | 0.088 | 44 |
| Ex. 8 | A 8 | 1 (20), 4 (10) | B1 | CG1 | 0.098 | 51 |
| Ex. 9 | A 9 | 1 (10), B (30) | B1 | CG1 | 0.095 | 51 |
| Ex. 10 | A10 | 4 (40) | B2 | CG1 | 0.090 | 63 |
| Ex. 11 | A11 | 4 (40) | B3 | CG1 | 0.091 | 62 |
| Ex. 12 | A12 | 4 (30), C (20) | B3 | CG1 | 0.090 | 53 |
| Ex. 13 | A13 | 1 (40) | B1 | CG2 | 0.089 | 28 |
| Ex. 14 | A14 | 4 (40) | B2 | CG2 | 0.090 | 57 |
| Ex. 14X | A14X | 1 (40) | B2 | CG3 | 0.091 | 32 |
| Ex. 15 | A15 | 4 (40) | B3 | CG2 | 0.094 | 65 |
| Ex. 16 | A16 | 4 (30), D (20) | B1 | CG1 | 0.092 | 52 |
| Ex. 17 | A17 | 1 (40) | B1 | CG4 | 0.094 | 35 |
| Comp. Ex. 7 | P 7 | 1 (2), B (30) | B1 | CG1 | 0.100 | 78 |
| Comp. Ex. 8 | P 8 | B (40) | B1 | CG1 | 0.101 | 80 |
| Comp. Ex. 9 | P 9 | E (40) | B1 | CG1 | 0.099 | 84 |
| Comp. Ex. 12 | P12 | F (40) | B1 | CG5 | 0.420 | 40 |

It is found from the results shown in Table 1 that the electrophotographic photoreceptor of the present invention has high sensitivity and low VL and has favorable electric characteristics. Further, it is found to be excellent in compatibility with various binder resins.

(Image Formation Test, and Test on Stability and Durability of Electrophotographic Photoreceptor)

Example 25

To an aluminum tube having a diameter of 3 cm and a length of 25.4 cm, to the surface of which an anodic oxidation treatment and a sealing treatment were applied, the coating liquid for formation of charge generation layer and the coating liquid for formation of charge transport layer prepared in the same manner as in Example 1 were sequentially applied by dip coating and dried to prepare an electrophotographic photoreceptor drum with a thickness of the charge generation layer of 0.3 μm and a thickness of the charge transport layer of 25 μm. This drum was mounted on a laser printer Laser Jet 4 (LJ4) manufactured by Hewlett-Packard Japan, Ltd., and an image test was carried out at a temperature of 35° C. under a humidity of 85% (hereinafter sometimes referred to as H/H environment) and as a result, a favorable image free from image defects and noises was obtained. Then, 10,000-sheet continuous printing was carried out, but no image deterioration such as ghosts or fogging was observed, and no image defects due to leakage occurred.

Example 26

To an aluminum tube having a diameter of 2 cm and a length of 25.1 cm, to the surface of which an anodic oxidation treatment and a sealing treatment were applied, the coating liquid for formation of charge generation layer and the coating liquid for formation of charge transport layer prepared in the same manner as in Example 4 were sequentially applied by dip coating and dried to prepare an electrophotographic photoreceptor drum with a thickness of the charge generation layer of 0.3 μm and a thickness of the charge transport layer of 15 μm. Four such drums were mounted on a tandem color laser printer C1616 manufactured by Fuji Xerox Co., Ltd., and an image test was carried out in H/H environment and as a result, a favorable image free from image effects and noises was obtained. Then, 1,000-sheet continuous printing was carried out, but no image deterioration such as leakage, ghosts or fogging was observed, and printing could be carried out stably.

Comparative Example 13

To an aluminum tube having a diameter of 2 cm and a length of 25.1 cm, to the surface of which an anodic oxidation treatment and a sealing treatment were applied, the coating liquid for formation of charge generation layer and the coating liquid for formation of charge transport layer prepared in the same manner as in Comparative Example 8 were sequentially applied by dip coating and dried to prepare an electrophotographic photoreceptor drum with a thickness of the charge generation layer of 0.3 μm and a thickness of the charge transport layer of 15 μm. Four such drums were mounted on a tandem color laser printer C1616 manufactured by Fuji Xerox Co., Ltd., and an image test was carried out in H/H environment and as a result, a favorable image free from image effects and noises was obtained. Then, 1,000-sheet continuous printing was carried out, whereupon image deterioration due to fogging was observed.

Example 27

On an aluminum tube having a diameter of 2 cm and a length of 25.1 cm, an undercoat layer was formed by a means disclosed in "Example 13" in JP-A-2005-99791. Then, the coating liquid for formation of charge generation layer and the coating liquid for formation of charge transport layer prepared in the same manner as in Example 4 were sequentially applied by dip coating and dried to prepare an electrophotographic photoreceptor drum with a thickness of the charge generation layer of 0.3 μm and a thickness of the charge transport layer of 15 μm. Four such drums were mounted on a tandem color laser printer C1616 manufactured by Fuji Xerox Co., Ltd., and an image test was carried out in H/H environment, and as a result, a favorable image free from image effects and noises was obtained. Then, 1,000-sheet continuous printing was carried out, but no image deterioration such as leakage, ghosts or fogging was observed, and printing could be carried out stably.

Example 28

The electrophotographic photoreceptor drum obtained in Example 25 was mounted on a commercially available facsimile machine (UF-890, manufactured by Panasonic Communications Co., Ltd.), and character images, and solid black and solid white images were formed in an environment at a temperature of 25° C. under a relative humidity of 50% (hereinafter sometimes referred to as N/N environment).

Comparative Example 14

The electrophotographic photoreceptor drum obtained in Comparative Example 13 was mounted on a commercially available facsimile machine (UF-890, manufactured by Panasonic Communications Co., Ltd.), and character images, and solid black and solid white images were formed in an environment at a temperature of 25° C. under a relative humidity of 50% (hereinafter sometimes referred to as N/N environment).

Evaluation methods for Example 28 and Comparative Example 14 are shown below.

(Measurements of Toner Consumption and Transfer Ratio)

The electrophotographic photoreceptor drum was mounted on a commercially available facsimile machine (UF-890, manufactured by Panasonic Communications Co., Ltd.), and 10,000 sheet-image forming was carried out in N/N environment. For the formed images, a 3% print pattern was used.

Prior to initiation of the image forming, the masses of a toner box and a waste toner box were measured, and every time of 1,000 sheet-, 3,000 sheet-, 5,000 sheet-, 7,000 sheet- and 10,000 sheet-image forming, the respective masses were measured. From the change in the mass of the toner box, "the toner consumption" per sheet of the image was obtained. Likewise, every time of 1,000 sheet-, 3,000 sheet-, 5,000 sheet-, 7,000 sheet- and 10,000 sheet-image forming, the masses of the waste toner box and the toner box were measured, and from the following formula, "the transfer ratio" was calculated. The results are shown in Table 2.

$$\text{Transfer rate (\%)} = 100 \times \frac{\text{Weight reduction of toner box} - \text{Weight increase of waste toner box}}{\text{Weight reduction of toner box}}$$

(Measurement of Image Density, Evaluation of Character Images)

Further, every time of 1,000 sheet-, 3,000 sheet-, 5,000 sheet-, 7,000 sheet- and 10,000 sheet-image forming, character images, and solid black and solid white images were formed. The "image density" was obtained by measuring the solid black image by means of a Macbeth densitometer (RD-920D, manufactured by Macbeth). Correction of the densitometer was carried out with a black standard of 1.8 and a white standard of 0.05.

Evaluation of "character image" was carried out by visually observing the character image for partial fading, thickening or thinning of characters and judged by the following standards. The results are shown in Table 2.

Standards for evaluation of character image:

◎: Excellent

○: Good

TABLE 2

| No. | Toner consumption (mg/sheet) | Transfer ratio (%) | Image density | Character image |
|---|---|---|---|---|
| Ex. 28 | 24.3 | 78 | 1.5 | ◎ |
| Comp. Ex. 14 | 34.0 | 75 | 1.5 | ○ |

Example 29

To an aluminum tube having a diameter of 3 cm, to the surface of which an anodic oxidation treatment and a sealing treatment were applied, the coating liquid for formation of charge generation layer and the coating liquid for formation of charge transport layer prepared in the same manner as in Example 4 were sequentially applied by dip coating and dried to prepare an electrophotographic photoreceptor drum with a thickness of the charge generation layer of 0.3 μm and a thickness of the charge transport layer of 8 μm. This drum was mounted on a laser printer LP-1800 manufactured by Seiko Epson Corporation, and a character image and a photographic image were formed in H/H environment. 3,000 sheets were printed, whereby favorable images were obtained.

Comparative Example 15

An electrophotographic photoreceptor drum was prepared in the same manner as in Example 29 except that instead of using the charge transport material (4), the compound (C) was used, and the image characteristics were examined in the same manner, whereby after 3,000 sheets printing, fogging was observed.

Preparation Example 10

Preparation of CG6

In a nitrogen atmosphere, 66.6 g of phthalonitrile was suspended in 353 mL of diphenylmethane, and a mixed liquid comprising 15.0 g of titanium tetrachloride and 25 mL of diphenylmethane was added at 40° C. The temperature was raised to from 205 to 210° C. over a period of about one hour, and then, a mixed liquid comprising 10.0 g of titanium tetrachloride and 16 mL of diphenylmethane was dropwise added, followed by a reaction at from 205 to 210° C. for 5 hours. The product was subjected to hot filtration at from 130 to 140° C. and then sequentially washed with N-methylpyrrolidone (hereinafter referred to simply as "NMP") and n-butanol. Then, in 600 mL of n-butanol, heating and refluxing for two hours were repeated twice, and suspension washing with NMP, water and methanol were carried out, followed by drying to obtain 47.0 g of B-form oxytitanium phthalocyanine.

20.0 g of this B-form oxytitanium phthalocyanine was shaked together with 120 mL of glass beads (diameter: 1.0 mm to 1.4 mm) by a paint shaker for 25 hours, and oxytitanium phthalocyanine was washed out with methanol, followed by filtration to obtain amorphous oxytitanium phthalocyanine. The obtained amorphous oxytitanium phthalocyanine was suspended in 210 mL of water and then added to 40 mL of toluene, followed by stirring at 60° C. for one hour. Water was discarded by decantation, followed by methanol suspension washing, filtration and drying for crystal conversion operation to obtain 19.0 g of the desired oxytitanium phthalocyanine composition (hereinafter sometimes referred to as "CG6").

Figure 2:
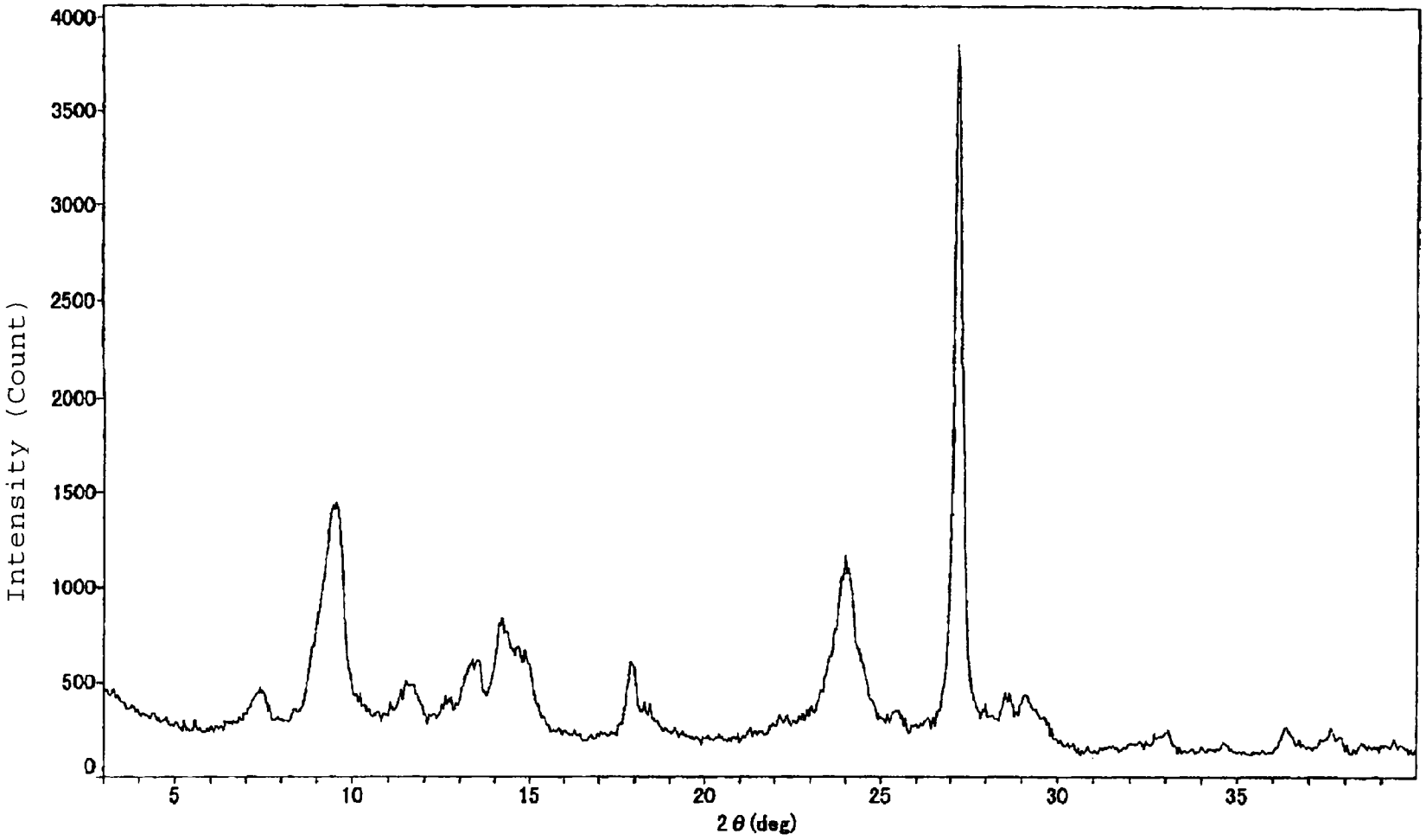
FIG. 2 is a powder X-ray diffraction spectrum by CuKα characteristic X-ray of the oxytitanium phthalocyanine composition "CG6" obtained in Preparation Example 10.
Figure 3:
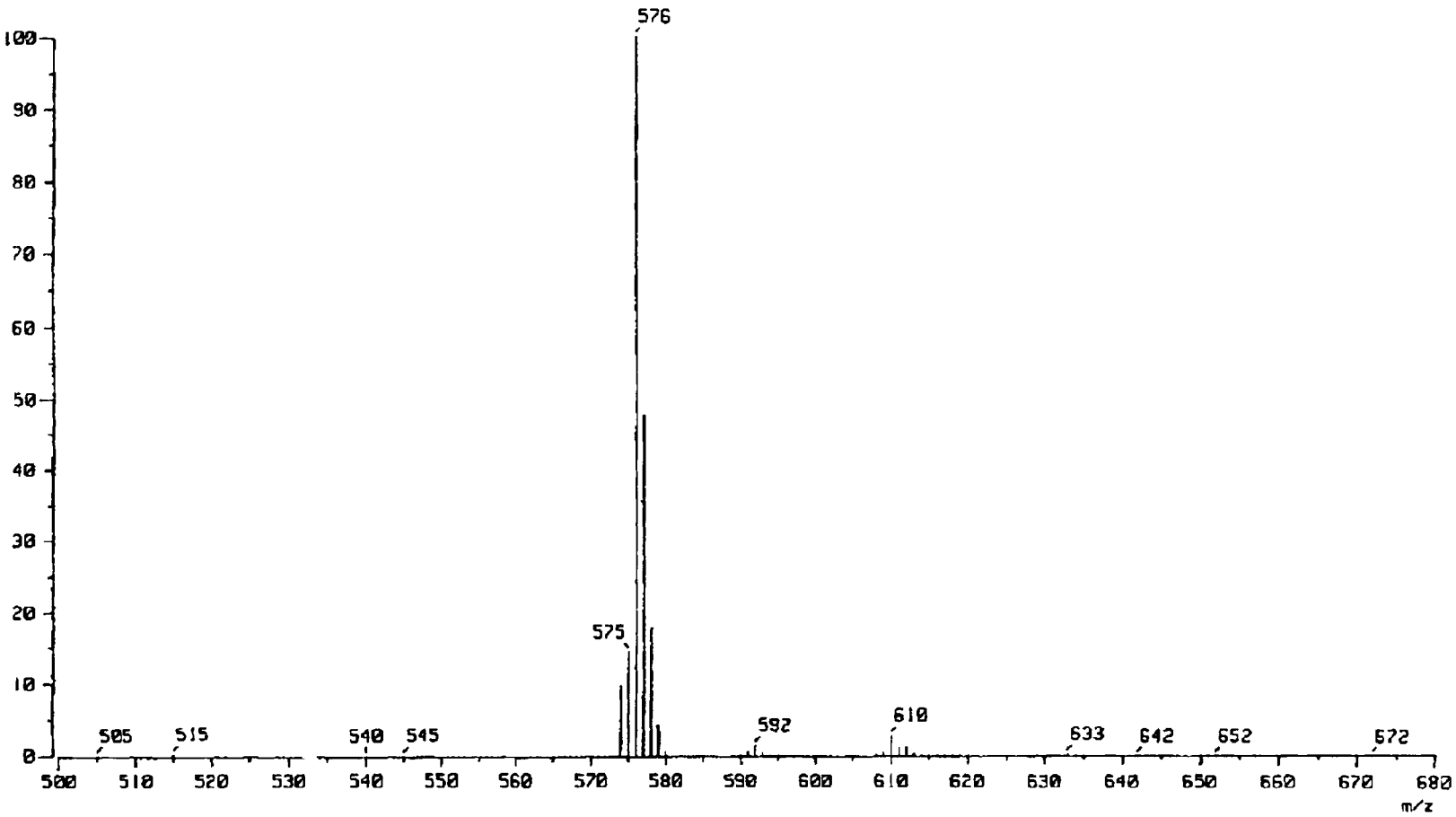
FIG. 3 is a mass spectrum of the oxytitanium phthalocyanine composition "CG6" obtained in Preparation Example 10.

The powder X-ray diffraction spectrum by CuKα characteristic X-ray, of the obtained oxytitanium phthalocyanine composition, is shown in FIG. 2. In this X-ray diffraction spectrum, the maximum diffraction peak was observed at a Bragg angle)(2θ±0.2°) of 27.3°. The mass spectrum of the obtained oxytitanium phthalocyanine composition is shown in FIG. 3, and in this mass spectrum, at m/z: 576, a peak of non-substituted oxytitanium phthalocyanine was observed, and at m/z: 610, a peak of chlorinated oxytitanium phthalocyanine was observed. The ratio of the peak intensity of the chlorinated oxytitanium phthalocyanine to the peak intensity of the non-substituted oxytitanium phthalocyanine was measured and found to be 0.028.

Preparation Example 11

Preparation of CG7

10 Parts of 3-hydroxynaphthalic anhydride and 5.7 parts of 3,4-diaminotoluene were dissolved and stirred in a mixed solvent of 23 parts of glacial acetic acid and 115 parts of nitrobenzene and reacted for two hours at a boiling point of acetic acid. After the reaction, the reaction solution was cooled to room temperature, and the precipitated crystal was collected by filtration, washed with 20 parts of methanol and then dried.

3 parts of the obtained solid was dissolved in 300 parts of N-methylpyrrolidone, and then, an N-methylpyrrolidone solution of a tetrazonium hydrofluoroborate of 2-(m-aminophenyl)-5-(p-aminophenyl)-1,3,4-oxadiazole was dropwise added, followed by stirring for 30 minutes. Then, at the same temperature, 7 parts of a saturated sodium acetate aqueous solution was slowly dropwise added to carry out a coupling reaction. After completion of the dropwise addition, stirring was continued at the same temperature for two hours. After completion of the stirring, the solid was collected by filtration, washed with N-methylpyrrolidone and methanol and then dried to obtain a composition of the following 8 types of compounds (hereinafter sometimes referred to as "CG7").

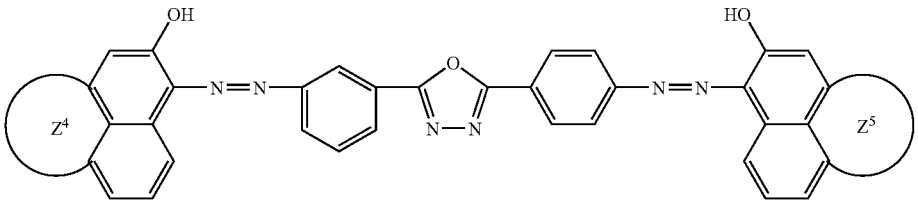

In the above formula, Z4 represents one structure selected from the group consisting of the following four structures.

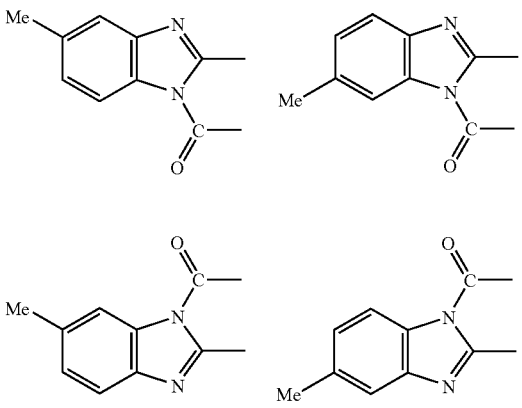

Further, in the above formula, Z5 represents one structure selected from the group consisting of the following four structures.

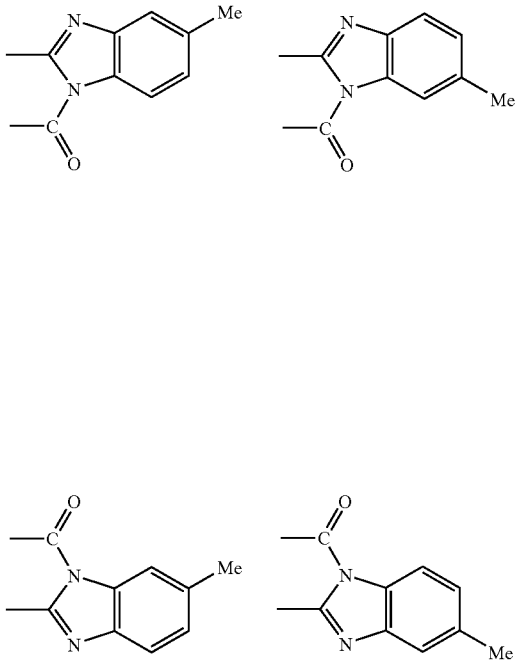

Example 31

An electrophotographic photoreceptor E1 was prepared in the same manner as in Example 1 except that instead of CG1 used in Example 1, CG6 was used, and evaluation of the electrical characteristics was carried out in the same manner as in Example 1. The results are shown in Table 3.

Example 32

An electrophotographic photoreceptor E2 was prepared in the same manner as in Example 1 except that instead of the binder resin (B1) used in Example 1, the following binder resin (X1) (viscosity average molecular weight: 50,000) was used, and evaluation of the electrical characteristics was carried out in the same manner as in Example 1. The results are shown in Table 3.

Binder resin (X1)

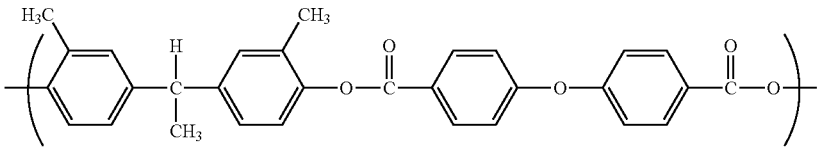

Example 33

An electrophotographic photoreceptor E3 was prepared in the same manner as in Example 1 except that instead of the binder resin (B1) used in Example 1, 50 parts of the following binder resin (X2) (viscosity average molecular weight: 20,000) and 50 parts of the binder resin (B2) were used, and evaluation of the electrical characteristics was carried out in the same manner as in Example 1. The results are shown in Table 3.

Binder resin (X2)

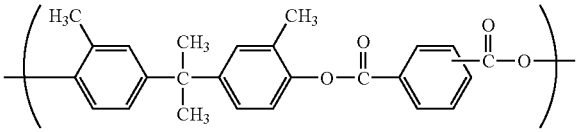

Example 34

An electrophotographic photoreceptor E4 was prepared in the same manner as in Example 1 except that instead of the charge transport material (1) used in Example 1, the following charge transport material (7) was used, and evaluation of the electrical characteristics was carried out in the same manner as in Example 1. The results are shown in Table 3.

Charge transport material (7)

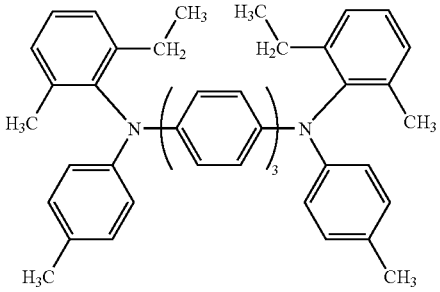

TABLE 3

| No. | Photo-recep-tor No. | Charge transport material (parts by mass | Binder resin (parts by mass) | Charge gener-ation material | Half decay exposure (μJ/cm$^2$) | VL (−V) |
|---|---|---|---|---|---|---|
| Ex. 31 | E1 | 1 (40) | B1 | CG6 | 0.094 | 39 |
| Ex. 32 | E2 | 1 (40) | X1 | CG1 | 0.092 | 36 |

TABLE 3-continued

| No. | Photo-recep-tor No. | Charge transport material (parts by mass | Binder resin (parts by mass) | Charge gener-ation material | Half decay exposure (μJ/cm$^2$) | VL (−V) |
|---|---|---|---|---|---|---|
| Ex. 33 | E3 | 1 (40) | X2 (50) B2 (50) | CG1 | 0.095 | 43 |
| Ex. 34 | E4 | 7 (40) | B1 | CG1 | 0.097 | 52 |

Example 35

1 kg of a raw slurry obtained by mixing 50 parts of surface-treated titanium oxide obtained by mixing rutile titanium oxide ("TTO55N" manufactured by Ishihara Sangyo Kaisha, Ltd.) having an average primary particle size of 40 nm and methyldimethoxysilane ("TSL8117" manufactured by GE Toshiba Silicones) in an amount of 3 wt % based on the titanium oxide by a Henschel mixer, and 120 parts of methanol, was subjected to dispersion treatment by using zirconia beads (YTZ manufactured by NIKKATO CORPORATION) having a diameter of about 100 μm as a dispersing medium, by using ULTRA APEX MILL (model UAM-015, manufactured by KOTOBUKI INDUSTRIES CO., LTD.) having a mill volume of about 0.15 L at a rotor circumferential speed of 10 m/sec in a liquid-circulating state with a liquid flow rate of 10 kg/hr for one hour to prepare a titanium oxide dispersion liquid.

The above titanium oxide dispersion liquid, a solvent mixture of methanol/1-propanol/toluene, and pellets of a copolymer polyamide comprising ε-caprolactam (compound represented by the following formula (A))/bis(4-amino-3-methylcyclohexyl)methane (compound represented by the following formula (B))/hexamethylenediamine (compound represented by the following formula (C))/decamethylenedicarboxylic acid (compound represented by the following formula (D))/octadecamethylenedicarboxylic acid (compound represented by the following formula (E)) in a molar ratio of 60%/15%/5%/15%/5% were stirred and mixed with heating to dissolve the polyamide pellets. Then, ultrasonic dispersion treatment by an ultrasonic oscillator at an output of 1,200 W was carried out for one hour, and then the mixture was subjected to filtration with a PTFE membrane filter (Mitex LC manufactured by ADVANTEC) with a pore size of 5 μm, to obtain dispersion A for formation of undercoat layer containing surface-treated titanium oxide/copolymer polyamide in a mass ratio of 3/1, in a solvent mixture of methanol/1-propanol/toluene in a mass ratio of 7/1/2 at a concentration of solid content contained of 18.0 mass %:

A

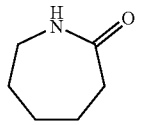

B

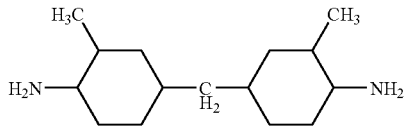

C

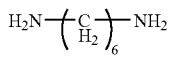

D

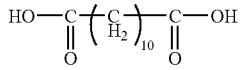

E

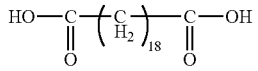

The dispersion A for formation of undercoat layer was applied to a non-anodized aluminum cylinder (outer diameter: 30 mm, length: 351 mm, thickness: 1.0 mm) by dip coating to form an undercoat layer so that the thickness would be 1.5 μm after drying.

Then, 30 parts of 1,2-dimethoxyethane was added to CG7, followed by pulverization by a sand grinding mill for 8 hours to carry out pulverization and dispersion treatment. Then, it was mixed with a binder resin solution having 0.75 part of polyvinyl butyral (tradename "Denka Butyral" #6000C, manufactured by Denki Kagaku Kogyo Kabushiki Kaisha) and 0.75 part of a phenoxy resin (PKHH, manufactured by Union Carbide) dissolved in 28.5 parts of 1,2-dimethoxyethane, and further, 13.5 parts of a mixed liquid of 1,2-dimethoxyethane and 4-methoxy-4-methyl-2-pentanone in an optional ratio, was mixed to obtain a charge generation layer-coating liquid having a solid content concentration of 4.0 mass %.

By using such a charge generation layer-coating liquid, a charge generation layer was prepared on the undercoat layer, so that the film thickness after drying would be 0.3 μm (0.3 g/m$^2$).

Then, 40 parts of a charge transport material (1), 3 parts of an antioxidant having the following structure, 0.05 part of silicone oil as a leveling agent (tradename "KF96", manufactured by Shin-Etsu Chemical Co., Ltd.) and 100 parts of the binder resin (B1) were dissolved in 480 parts of tetrahydrofuran and 120 parts of toluene to prepare a charge transport layer-coating liquid, which was applied by dip-coating on the above charge generation layer so that the film thickness after drying would be 18 μm, thereby to obtain an electrophotographic photoreceptor drum BE1 having a lamination type photosensitive layer.

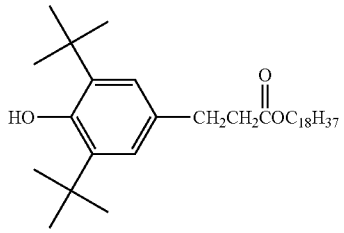

Comparative Example 21

In the same manner as in Example 35 except that instead of the charge transport material (1) used in Example 35, the charge transport material (C) was used, a photoreceptor drum BH1 was prepared.

Method for Evaluation of Example 35 and Comparative Example 21

Each electrophotographic photoreceptor obtained was mounted on a photoreceptor characteristic evaluation apparatus (manufactured by Mitsubishi Chemical Corporation), and evaluation of electrical characteristics was carried out by cycles of charging, exposure, potential measurement and charge removal.

Each electrophotographic photoreceptor was rotated at a constant rotational speed of 30 rpm. In an environment at a temperature of 25° C. under a humidity of 50%, the photoreceptor was charged so that the initial surface potential would be −700 V, and for the exposure, a monochromatic light of 427 nm was used which was obtained from a halogen lamp light by means of an interference filter, whereby the exposure amount (hereinafter sometimes referred to as the sensitivity) where the surface potential becomes −350 V, and the surface potential (hereinafter referred to as VL) at the time of irradiation with a light quantity of 1.11 μJ/cm$^2$, were obtained. The time from the exposure to the potential measurement was 389 msec. As the charge removal light, white light of 75 lux was used, and the exposure width was 5 mm. After irradiation with the charge removal light, the residual potential (hereinafter referred to as Vr) was measured.

The sensitivity is the exposure amount required for the surface potential to become ½ of the initial potential, and the smaller the numerical value, the higher the sensitivity. Further, VL and Vr are potentials after the exposure, and the smaller the value, the better as an electrical characteristic. The results are shown in the following Table 4.

TABLE 4

| No. | Photoreceptor No | Charge transport material (parts by mass | Binder resin | Charge generation material | Sensitivity (μJ/cm$^2$) | VL (−V) | Vr (−V) |
|---|---|---|---|---|---|---|---|
| Ex. 35 | BE1 | 1 (40) | B1 | CG7 | 0.42 | 58 | 16 |
| Comp. Ex. 21 | BH1 | C (40) | B1 | CG7 | Measurement infeasible | Measurement infeasible | Measurement infeasible |

In Comparative Example 21, the electrical characteristics were very poor, and the measurement was infeasible.

Evaluation of Images of Examples 35 and Comparative Example 21

The exposure portion of MICROLINE Pro 9800PS-E (manufactured by Oki Data Corporation) suitable for A3 printing was modified so that a small spot irradiation type blue LED (B3MP-8: 470 nm), manufactured by NISSIN ELECTRONIC CO., LTD. could be irradiated to a photoreceptor.

On this modified apparatus, the photoreceptor drum E2 was mounted and permitted to draw a line, whereby a good image was obtained. Further, the above small spot irradiation type blue LED was connected to a stroboscopic illumination power source LPS-203KS and permitted to draw dots, whereby it was possible to obtain dot images with a radius of 8 mm.

INDUSTRIAL APPLICABILITY

The electrophotographic photoreceptor of the present invention is excellent in electrical characteristics and image characteristics and less susceptible to a change in characteristics due to a change in the environment and has high durability, and thus it can be widely utilized in all fields where an electrophotographic photoreceptor is useful, i.e. in the fields of copying machines, printers, facsimile machines, printing machines, etc.

The entire disclosure of Japanese Patent Application No. 2005-349209 filed on Dec. 2, 2005 including specification, claims, drawings and summary is incorporated herein by reference in its entirety.

The invention claimed is:

1. An electrophotographic photoreceptor, comprising an electroconductive substrate, a charge transport layer, and a charge generation layer formed on the substrate, wherein:

the charge transport layer comprises a charge transport material represented by formula (1) and a binder resin, and the mass ratio of the charge transport material to the binder resin is from 5/100 to 45/100:

(1)

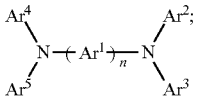

$Ar^1$ is an arylene group which may have a substituent;

each of $Ar^2$, $Ar^3$, $Ar^4$ and $Ar^5$ is an aryl group which may have a substituent;

n is an integer of from 3 to 6;

the charge generation layer comprises oxytitanium phthalocyanine, such that the oxytitanium phthalocyanine is crystalline oxytitanium phthalocyanine showing peaks at Bragg angles (2θ±0.2°) of 9.5°, 24.1° and 27.3° in an X-ray diffraction spectrum by CuKα ray; and the electrophotographic photoreceptor has a half decay exposure in a range of from 0.089 to 0.096 (μJ/cm$^2$) and VL in a range of from 27 to 63 (−V).

2. An image forming apparatus, comprising the electrophotographic photoreceptor according to claim 1.

3. An image forming apparatus, comprising the electrophotographic photoreceptor according to claim 1, wherein the image forming apparatus is capable of exposing the electrophotographic photoreceptor to monochromatic light having a wavelength of from 380 to 500 nm to form an image.

4. The electrophotographic photoreceptor according to claim 1, wherein n is an integer of from 4 to 6.

5. An image forming apparatus, comprising the electrophotographic photoreceptor according to claim 1, wherein the image forming apparatus is capable of charging the electrophotographic photoreceptor with a charger disposed in contact with the electrophotographic photoreceptor to form an image.

6. An electrophotographic photoreceptor, comprising an electroconductive substrate, a charge transport layer, and a charge generation layer formed on the substrate, wherein:

the charge transport layer comprises a charge transport material represented by formula (1), a plurality of charge transport materials, and a binder resin, such that a mass ratio of the total mass of the plurality of charge transport materials to the binder resin is from 25/100 to 55/100:

(1)

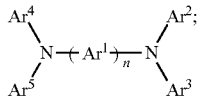

$Ar^1$ is an arylene group which may have a substituent;

each of $Ar^2$, $Ar^3$, $Ar^4$ and $Ar^5$ is an aryl group which may have a substituent; and n is an integer of from 3 to 6;

the charge generation layer comprises oxytitanium phthalocyanine, such that the oxytitanium phthalocyanine is crystalline oxytitanium phthalocyanine showing peaks at Bragg angles (2θ+0.2°) of 9.5°, 24.1° and 27.3° in an X-ray diffraction spectrum by CuKα ray; and the electrophotographic photoreceptor has a half decay exposure in a range of from 0.088 to 0.098 (μJ/cm$^2$) and VL in a range of from 44 to 53 (−V).

7. The electrophotographic photoreceptor according to claim 6, wherein the oxytitanium phthalocyanine is crystalline oxytitanium phthalocyanine showing peaks at Bragg angles (2θ±0.2°) of 9.5°, 24.1° and 27.3° in an X-ray diffraction spectrum by CuKα ray.

8. The electrophotographic photoreceptor according to claim 6, wherein n is an integer of from 4 to 6.

9. An image forming apparatus, comprising the electrophotographic photoreceptor according to claim 6, wherein the imaging forming apparatus is capable of exposing the electrophotographic photoreceptor to monochromatic light having a wavelength of from 380 to 500 nm to form an image.

10. An image forming apparatus, comprising the electrophotographic photoreceptor according to claim 6, wherein the image forming apparatus is capable of charging the electrophotographic photoreceptor with a charger disposed in contact with the electrophotographic photoreceptor to form an image.

11. An electrophotographic photoreceptor, comprising an electroconductive substrate, a charge transport layer, and a charge generation layer formed on the substrate, wherein:

the charge transport layer comprises a charge transport material represented by formula (1) and the charge generation layer comprises oxytitanium phthalocyanine, such that the oxytitanium phthalocyanine is obtained by chemical treatment of a phthalocyanine crystal precursor, followed by contact with an organic solvent to obtain oxytitanium phthalocyanine showing main diffraction peaks at Bragg angles (2θ+0.2°) of 9.5°, 24.1° and 27.2° in an X-ray diffraction spectrum by CuKα ray (wavelength: 1.541 Å):

(1)

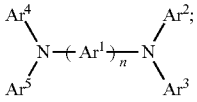

$Ar^1$ is an arylene group which may have a substituent;

each of $Ar^2$, $Ar^3$, $Ar^4$ and $Ar^5$ is an aryl group which may have a substituent;

n is an integer of from 3 to 6; and the electrophotographic photoreceptor has a half decay exposure in a range of from 0.088 to 0.098 (μJ/cm$^2$) and VL in a range of from 27 to 63 (−V).

12. The electrophotographic photoreceptor according to claim 11, wherein n is an integer of from 4 to 6.

13. An image forming apparatus, comprising the electrophotographic photoreceptor according to claim 11, wherein the imaging forming apparatus is capable of exposing the electrophotographic photoreceptor to monochromatic light having a wavelength of from 380 to 500 nm to form an image.

14. An image forming apparatus, comprising the electrophotographic photoreceptor according to claim 11, wherein the image forming apparatus is capable of charging the electrophotographic photoreceptor with a charger disposed in contact with the electrophotographic photoreceptor to form an image.

15. An electrophotographic photoreceptor, comprising an electroconductive substrate, a charge transport layer, and a charge generation layer formed on the substrate, wherein:

the charge transport layer comprises a charge transport material represented by formula (1) and a polyarylate resin:

(1)

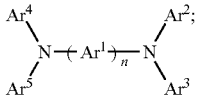

$Ar^1$ is an arylene group which may have a substituent;

each of $Ar^2$, $Ar^3$, $Ar^4$ and $Ar^5$ is an aryl group which may have a substituent;

n is an integer of from 3 to 6;

the charge generation layer comprises oxytitanium phthalocyanine, such that the oxytitanium phthalocyanine is crystalline oxytitanium phthalocyanine showing peaks at Bragg angles (2θ+0.2°) of 9.5°, 24.1° and 27.3° in an X-ray diffraction spectrum by CuKα ray; and the electrophotographic photoreceptor has a half decay exposure in a range of from 0.092 to 0.095 (μJ/cm$^2$) and VL in a range of from 36 to 43 (−V).

16. The electrophotographic photoreceptor according to claim 15, wherein n is an integer of from 4 to 6.

17. The electrophotographic photoreceptor of claim 15, wherein the binder resin has a viscosity average molecular weight of from 10,000 to 70,000.

18. An image forming apparatus, comprising the electrophotographic photoreceptor according to claim 15, wherein the imaging forming apparatus is capable of exposing the electrophotographic photoreceptor to monochromatic light having a wavelength of from 380 to 500 nm to form an image.

19. An image forming apparatus, comprising the electrophotographic photoreceptor according to claim 15, wherein the image forming apparatus is capable of charging the electrophotographic photoreceptor with a charger disposed in contact with the electrophotographic photoreceptor to form an image.

* * * * *